US012791188B2

(12) United States Patent
Naik et al.

(10) Patent No.: US 12,791,188 B2
(45) Date of Patent: Nov. 10, 2026

(54) TURBINE ENGINE HAVING A COMBUSTION SECTION WITH A FUEL SUPPLY ASSEMBLY

(71) Applicant: General Electric Company, Schenectady, NY (US)

(72) Inventors: Pradeep Naik, Bengaluru (IN); Clayton Stuart Cooper, Loveland, OH (US); Sibtosh Pal, Mason, OH (US); Michael A. Benjamin, West Chester, OH (US); Michael T. Bucaro, Arvada, CO (US); Karthikeyan Sampath, Bengaluru (IN); Steven C. Vise, Loveland, OH (US); Andrew Joseph Wickersham, Liberty Township, OH (US); Erich Alois Krammer, West Chester, OH (US)

(73) Assignee: General Electric Company, Evendale, OH (US)

( * ) Notice: Subject to any disclaimer, the term of this patent is extended or adjusted under 35 U.S.C. 154(b) by 6 days.

(21) Appl. No.: 18/431,619

(22) Filed: Feb. 2, 2024

(65) Prior Publication Data

US 2025/0251133 A1 Aug. 7, 2025

(51) Int. Cl.
*F23R 3/28* (2006.01)
*F23R 3/14* (2006.01)

(52) U.S. Cl.
CPC ..... *F23R 3/283* (2013.01); *F23R 3/14* (2013.01); *F23R 3/286* (2013.01)

(58) Field of Classification Search
CPC ..... F23R 3/286; F23R 3/14; F23R 3/283
See application file for complete search history.

(56) References Cited

U.S. PATENT DOCUMENTS 4,408,461 A 10/1983 Bruhwiler et al.
4,815,664 A * 3/1989 Tuthill ..... F23R 3/14 239/404
5,505,045 A 4/1996 Lee et al.
6,367,262 B1 4/2002 Mongia et al.
7,017,329 B2 3/2006 Farhangi et al.
(Continued)

FOREIGN PATENT DOCUMENTS

CN 104406196 A 3/2015
CN 108561898 A 9/2018
(Continued)

OTHER PUBLICATIONS

Database WPI; Week 201532; Thomas Scientific, London, GB; AN 2015-267224 XP002813229 and CN104406196A (Ins. Eng Thermophysics Chinese) Mar. 11, 2015.
(Continued)

*Primary Examiner* — Thomas P Burke
(74) *Attorney, Agent, or Firm* — Carter, DeLuca & Farrell LLP

(57) ABSTRACT

A turbine engine has a compressor section, a combustion section, and a turbine section in serial flow arrangement. The combustion section has a combustor liner and dome wall collectively forming at least a portion of a combustion chamber. The dome wall has an opening. The combustion section has a fuel supply assembly extending through the opening. The fuel supply assembly includes a fuel nozzle, a series of air injectors and flame shaping passages.

19 Claims, 22 Drawing Sheets

(56) References Cited

U.S. PATENT DOCUMENTS

| | | | | |
|---|---|---|---|---|
| 7,343,745 | B2 | 3/2008 | Inoue et al. | |
| 7,824,165 | B2 | 11/2010 | Davie et al. | |
| 7,891,190 | B2 | 2/2011 | Commaret et al. | |
| 8,066,509 | B2 | 11/2011 | Eroglu et al. | |
| 8,205,452 | B2 | 6/2012 | Boardman et al. | |
| 8,266,911 | B2 | 9/2012 | Evulet | |
| 10,180,256 | B2 | 1/2019 | Rullaud et al. | |
| 10,352,567 | B2 | 7/2019 | Wang et al. | |
| 10,731,861 | B2 | 8/2020 | Schlein | |
| 10,865,989 | B2 | 12/2020 | Sadasivuni | |
| 11,054,137 | B2 | 7/2021 | Choi | |
| 11,085,643 | B2 | 8/2021 | Freeman et al. | |
| 11,635,208 | B2 | 4/2023 | Choi | |
| 11,739,936 | B2 | 8/2023 | Bourgois et al. | |
| 2005/0106520 | A1 | 5/2005 | Cornwell et al. | |
| 2007/0003897 | A1 | 1/2007 | Koizumi et al. | |
| 2007/0289305 | A1* | 12/2007 | Oda | F23R 3/286 60/748 |
| 2008/0236165 | A1* | 10/2008 | Baudoin | F23R 3/343 60/746 |
| 2008/0289340 | A1* | 11/2008 | Oda | F23R 3/28 60/737 |
| 2008/0302105 | A1* | 12/2008 | Oda | F23R 3/28 60/737 |
| 2009/0111063 | A1 | 4/2009 | Boardman et al. | |
| 2010/0162716 | A1 | 7/2010 | Bastnagel et al. | |
| 2010/0275604 | A1 | 11/2010 | Hall | |
| 2010/0300102 | A1 | 12/2010 | Bathina et al. | |
| 2011/0162379 | A1 | 7/2011 | Baruah et al. | |
| 2011/0185703 | A1 | 8/2011 | Dodo et al. | |
| 2012/0151928 | A1 | 6/2012 | Patel et al. | |
| 2014/0109582 | A1 | 4/2014 | Shershnyov et al. | |
| 2015/0000299 | A1 | 1/2015 | Zuo et al. | |
| 2016/0010864 | A1 | 1/2016 | Abe et al. | |
| 2016/0230997 | A1* | 8/2016 | Donovan | F23R 3/14 |
| 2016/0290646 | A1 | 10/2016 | Abe et al. | |
| 2016/0377293 | A1 | 12/2016 | Short et al. | |
| 2017/0307218 | A1 | 10/2017 | Miyauchi et al. | |
| 2018/0299129 | A1 | 10/2018 | Parsania et al. | |
| 2019/0137103 | A1 | 5/2019 | Choi | |
| 2021/0381436 | A1* | 12/2021 | Matsuyama | F23R 3/283 |
| 2022/0333782 | A1* | 10/2022 | Vise | F23R 3/14 |
| 2022/0364509 | A1* | 11/2022 | Morenko | F02C 7/22 |
| 2022/0412563 | A1 | 12/2022 | Giridharan et al. | |
| 2023/0204213 | A1 | 6/2023 | Naik et al. | |
| 2023/0204215 | A1 | 6/2023 | Naik et al. | |
| 2023/0296245 | A1 | 9/2023 | Kim et al. | |

FOREIGN PATENT DOCUMENTS

| | | | |
|---|---|---|---|
| DE | 920720 | C | 11/1954 |
| EP | 1199522 | A2 | 4/2002 |
| EP | 2442026 | A1 | 4/2012 |
| EP | 4083511 | A1 | 11/2022 |
| EP | 4317783 | A1 | 2/2024 |
| WO | 2013/065624 | A1 | 5/2013 |
| WO | 2022202104 | A1 | 9/2022 |
| WO | 2023/180318 | A1 | 9/2023 |

OTHER PUBLICATIONS

Database WPI; Week 201870; Thomas Scientific, London, GB; AN 2018-779065; XP002813230 and CN108561898 A (AECC Sichuan Gas Turbine Estab) Sep. 21, 2018.

Extended European Search Report issued in corresponding application EP 25151865.0 dated Apr. 29, 2025.

Communication pursuant to Article 94(3) EPC issued in corresponding application EP 25 151 865.0 dated Apr. 20, 2026.

* cited by examiner

TURBINE ENGINE HAVING A COMBUSTION SECTION WITH A FUEL SUPPLY ASSEMBLY

TECHNICAL FIELD

The present subject matter relates generally to a turbine engine, and more specifically to a turbine engine having a combustion section including a fuel nozzle.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called NOx), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
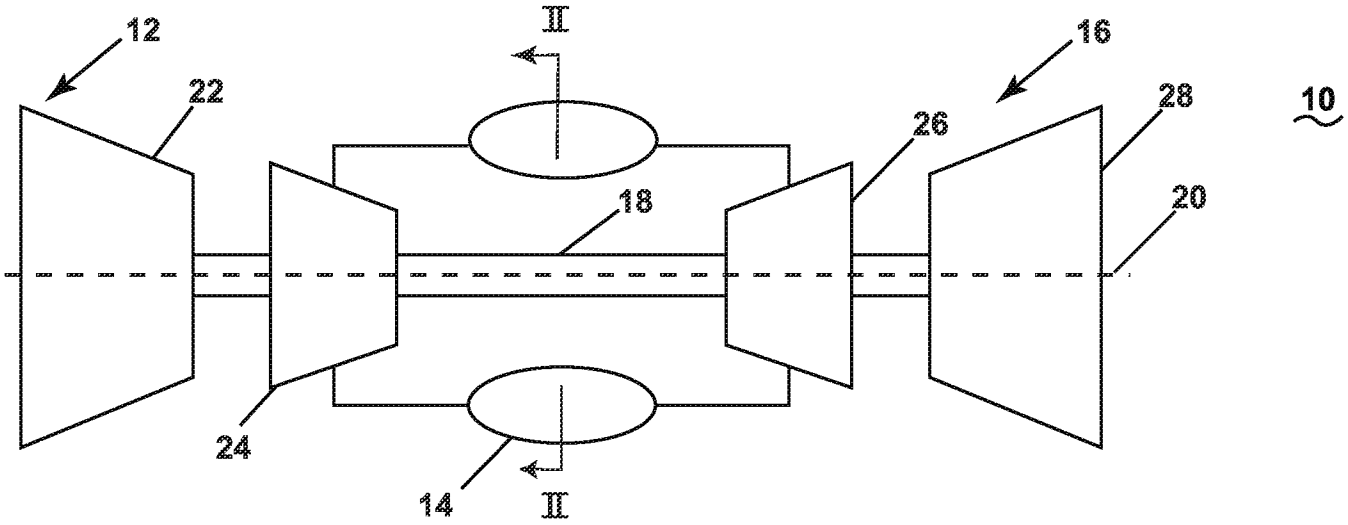
FIG. 1 is a schematic representation of a turbine engine, the turbine engine including a compression section, a combustion section, and a turbine section.

Aspects of the disclosure described herein are directed to a turbine engine including a combustion section including a fuel supply assembly. The fuel supply assembly includes a set of flame shaping passages, the set of flame shaping passages having an inner set of flame shaping passages and an outer set of flame shaping passages.

The fuel supply assembly is especially well-adapted for the use of hydrogen fuel (hereinafter, "H2 fuel"). Specifically, the fuel supply assembly is especially well-adapted to feed a flow of gaseous H2 fuel to the combustion chamber. H2 fuel, when compared to traditional fuels (e.g., carbon fuels, petroleum fuels, etc.), have a higher burn temperature and velocity. Further, flashback can occur when using H2 fuels. As used herein, flashback refers to unintended flame propagation when the H2 fuel is combusted. H2 fuel has higher volatility, meaning that once the H2 fuel is combusted or ignited, the flame generated by the ignition of the H2 fuel can expand in undesired location; in other words, flashback can occur. For example, the flame can expand into the fuel nozzle or igniter. The fuel supply assembly, as described herein, ensures flashback of the H2 fuel does not occur. Auto-ignition of the H2 fuel can occur if the H2 fuel is too hot. Auto-ignition of the H2 fuel can be undesirable in certain locations of the combustion section. The fuel supply assembly as described herein ensures that the temperature of the H2 fuel is below the auto-ignition temperature until at least when it is desired to ignite the H2 fuel.

In some aspects, the disclosed combustors can be utilized with gaseous fuel, such as hydrogen. Gaseous fuel, including hydrogen, spreads/disperses at a faster rate than atomized liquid fuel, which can involve less mixing time for the gaseous fuel, fuel mixing tube lengths can be shorter, and the flame from the gaseous fuel may be more likely to spread farther and faster, which can increase the risk of blowout and increase the impact of controlling the flame and limiting flame spread by controlling the dispersion of the gaseous fuel. Flame shaping formations, such as air tubes and flame shaping holes, can help contain gaseous fuel-air mixtures that have lower densities and higher velocities than with liquid fuels. For example, flame shaping formations can contain the gaseous fuel-air mixtures such that the flame velocity matches the flow velocity to provide a stable flame.

In some aspects, the gaseous fuel exits the fuel nozzle with a given speed and then mixes with air for combustion. As the fuel/air mixture burns, the flame propagates upstream. It can be desirable to control or maintain a constant flame in the combustor for ignition of subsequent fuel, and not to continually ignite the fuel with an ignitor.

For purposes of illustration, the present disclosure will be described with respect to a turbine engine (gas turbine engine). It will be understood, however, that aspects of the disclosure described herein are not so limited and that a fuel supply assembly as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

As used herein, the term "radius of curvature" equals the radius of a circular arc which best approximates the curve at that point. A linear, or flat surface has a radius of curvature of zero. A curved surface, therefore, has a non-zero radius of curvature.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16 in serial flow arrangement. A drive shaft 18 rotationally couples the compressor section 12 and the turbine section 16, such that rotation of one affects the rotation of the other, and defines a rotational axis or engine centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
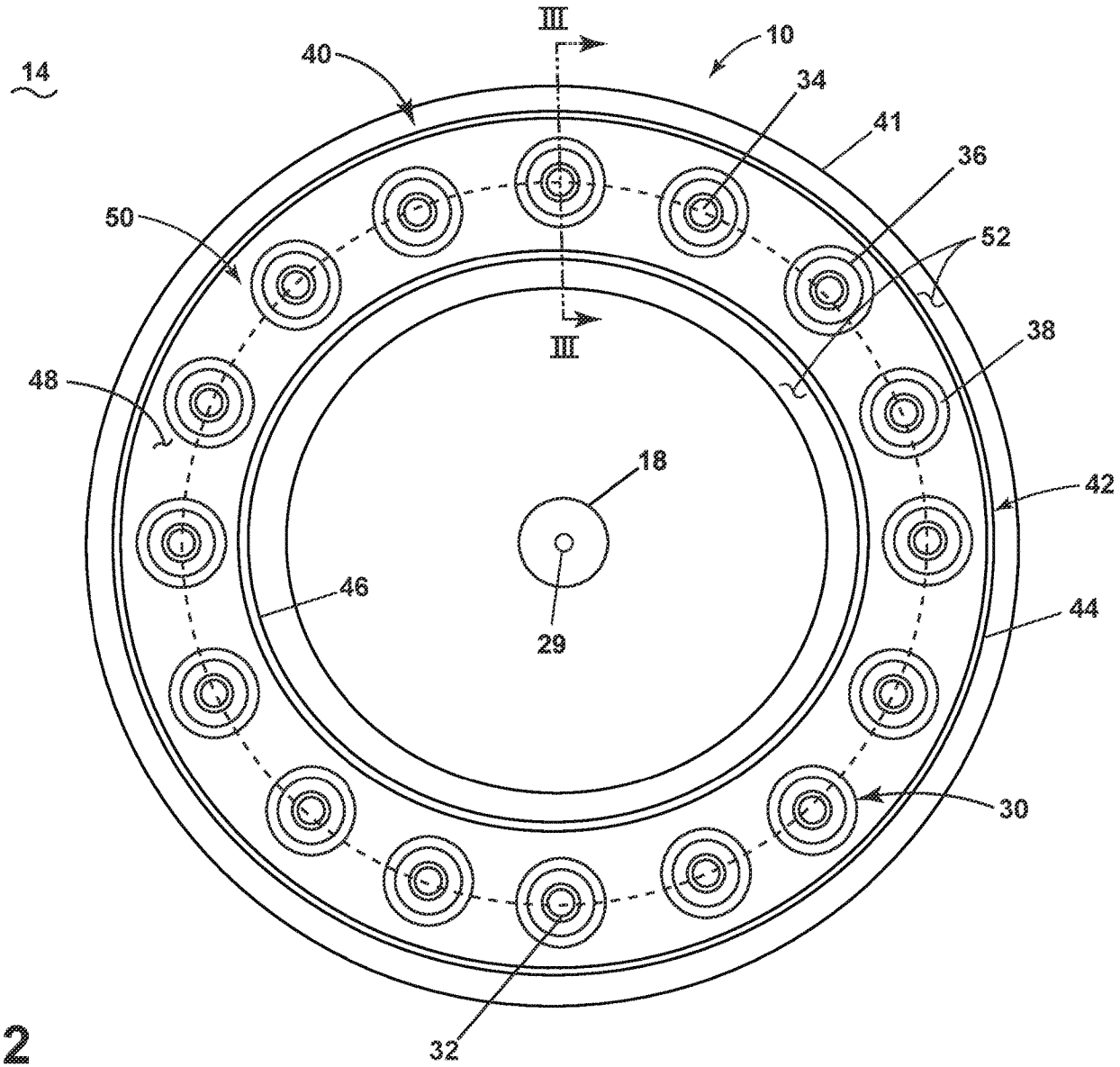
FIG. 2 is a cross-sectional view of the combustion section from FIG. 1 along line II-II according to one aspect of the disclosure herein.

FIG. 2 depicts a cross-sectional view of the combustion section 14 along line II-II of FIG. 1. The combustion section 14 can include a set of fuel supply assemblies 30 annularly arranged about a combustor centerline 29. The combustor centerline 29 can be the engine centerline 20 (FIG. 1) of the turbine engine 10. Additionally, or alternatively, the combustor centerline 29 can be a centerline for the combustion section 14, a single combustor, or a set of combustors that are arranged about the combustor centerline 29.

Each fuel supply assembly 32 in the set of fuel supply assemblies 30 includes a fuel nozzle 34, a set of fuel injectors 36, and a series of air injectors 38. The set of fuel supply assemblies 30 can include rich cups, lean cups, or a combination of both rich and lean cups annularly provided about the engine centerline 20. The set of fuel supply assemblies 30 are fluidly connected to a combustor 40. The combustor 40 is defined by a combustor liner 42. The combustor 40 can have a can, can-annular, or annular arrangement depending on the type of engine in which the combustor 40 is located. In a non-limiting example, the combustor 40 can have a combination arrangement as further described herein located within a casing 41 of the engine. The combustor liner 42, as illustrated by way of example, is annular. The combustor liner 42 can include an outer combustor liner 44 and an inner combustor liner 46 concentric with respect to each other and annular about the combustor centerline 29. A dome wall 48 together with the combustor liner 42 can define a combustion chamber 50 annular about the combustor centerline 29. The set of fuel supply assemblies 30 are fluidly coupled to the combustion chamber 50. A compressed air passageway 52 can be defined at least in part by both the combustor liner 42 and the casing 41.

Figure 3:
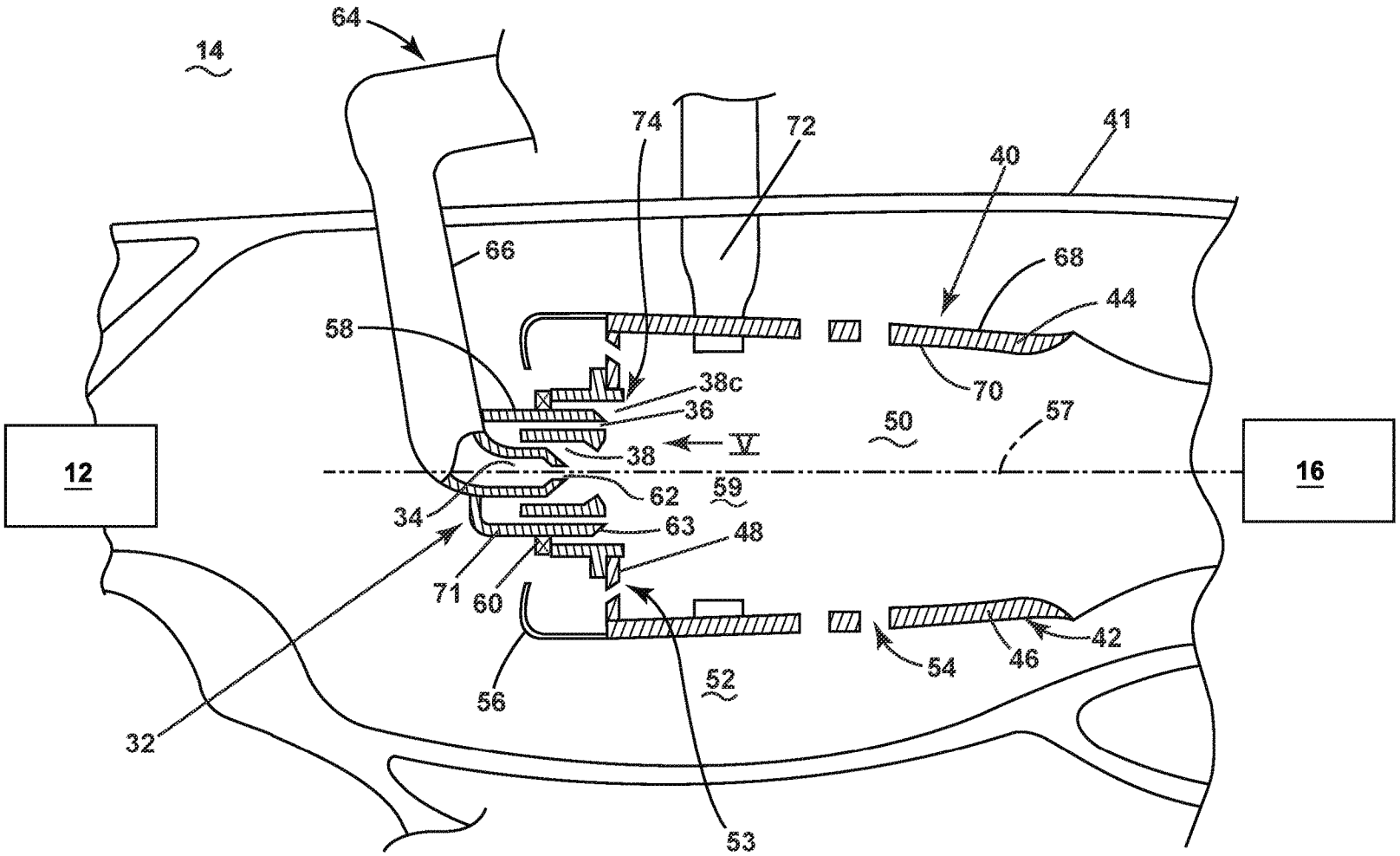
FIG. 3 is a schematic cross-sectional view taken along line III-III of FIG. 2 illustrating the combustion section.

FIG. 3 depicts a cross-section view taken along line III-III of FIG. 2 illustrating the combustion section 14. At least one dilution opening can fluidly connect the compressed air passageway 52 and the combustion chamber 50. By way of example, the at least one dilution opening is illustrated as a set of flame shaping openings 53 passing through the dome wall 48. The at least one dilution opening can further include a set of downstream dilution openings 54 extending through the combustor liner 42.

The fuel supply assembly 32 can be coupled to and disposed within a dome assembly 56. The fuel supply assembly 32 includes the fuel nozzle 34, the set of fuel injectors 36, and the series of air injectors 38 and at least one swirler 60. The fuel nozzle 34 defines a centerline axis 57. The fuel supply assembly 32 is defined by a single monolithic body 58 having concentric walls 71 arranged about the centerline axis 57 and spaced from each other to define the series of air injectors 38. In this manner the series of air injectors 38 are concentrically arranged about the fuel nozzle 34. An outermost air injector 38*c* is the radially outermost air injector in the series of air injectors 38. The fuel nozzle 34 terminates in a first fuel outlet 62. The set of fuel injectors 36 terminates in a second fuel outlet 63. The first fuel outlet 62 and the second fuel outlet 63 are both directly fluidly coupled to the combustion chamber 50. The fuel supply assembly 32 is fluidly coupled to a fuel inlet 64 via a passageway 66.

The at least one swirler 60 is any suitable component that is configured to impart a swirling motion to a flow of fluid from an upstream edge of the at least one swirler 60 to a downstream edge of the at least one swirler 60 such that the flow of fluid includes a helical or otherwise swirled flow downstream of the at least one swirler 60. As a non-limiting example, the at least one swirler 60 can be formed as a plurality of airfoils circumferentially spaced within the fuel nozzle 34 to define a fuel swirler and within each of the series of air injectors 38 to define an air swirler. The amount of swirl to the flow can be quantified by a "swirl number", which is a ratio of the axial flux of angular momentum to the axial flux of the axial momentum. The swirl number can be from 0.2 to 1.2. At least one swirler 60 associated with the outer most set of fuel injectors 36 can have zero swirl or low swirl. The swirl number associated with the outer most set of fuel injectors 36 can range from 0 to 0.6.

The dome wall 48 includes an opening 74 through which the fuel supply assembly 32 is received. The fuel supply assembly 32 is separate from the dome wall 48. In other words, the fuel supply assembly 32 is coupled to, but not integrally formed with, the dome wall 48.

Both the inner combustor liner 46 and the outer combustor liner 44 can have an outer surface 68 and an inner surface 70 at least partially defining the combustion chamber 50. The combustor liner 42 can be made of one continuous monolithic portion or be multiple monolithic portions assembled together to define the inner combustor liner 46 and the outer combustor liner 44. By way of non-limiting example, the outer surface 68 can define a first piece of the combustor liner 42 while the inner surface 70 can define a second piece of the combustor liner 42 that when assembled together form the combustor liner 42. As described herein, the combustor liner 42 includes the set of downstream dilution openings 54. It is further contemplated that the combustor liner 42 can be any type of combustor liner 42, including but not limited to a single wall or a double walled liner or a tile liner. An ignitor 72 can be provided at the combustor liner 42 and fluidly coupled to the combustion chamber 50, at any location, by way of non-limiting example, upstream of the set of downstream dilution openings 54.

Figure 4:
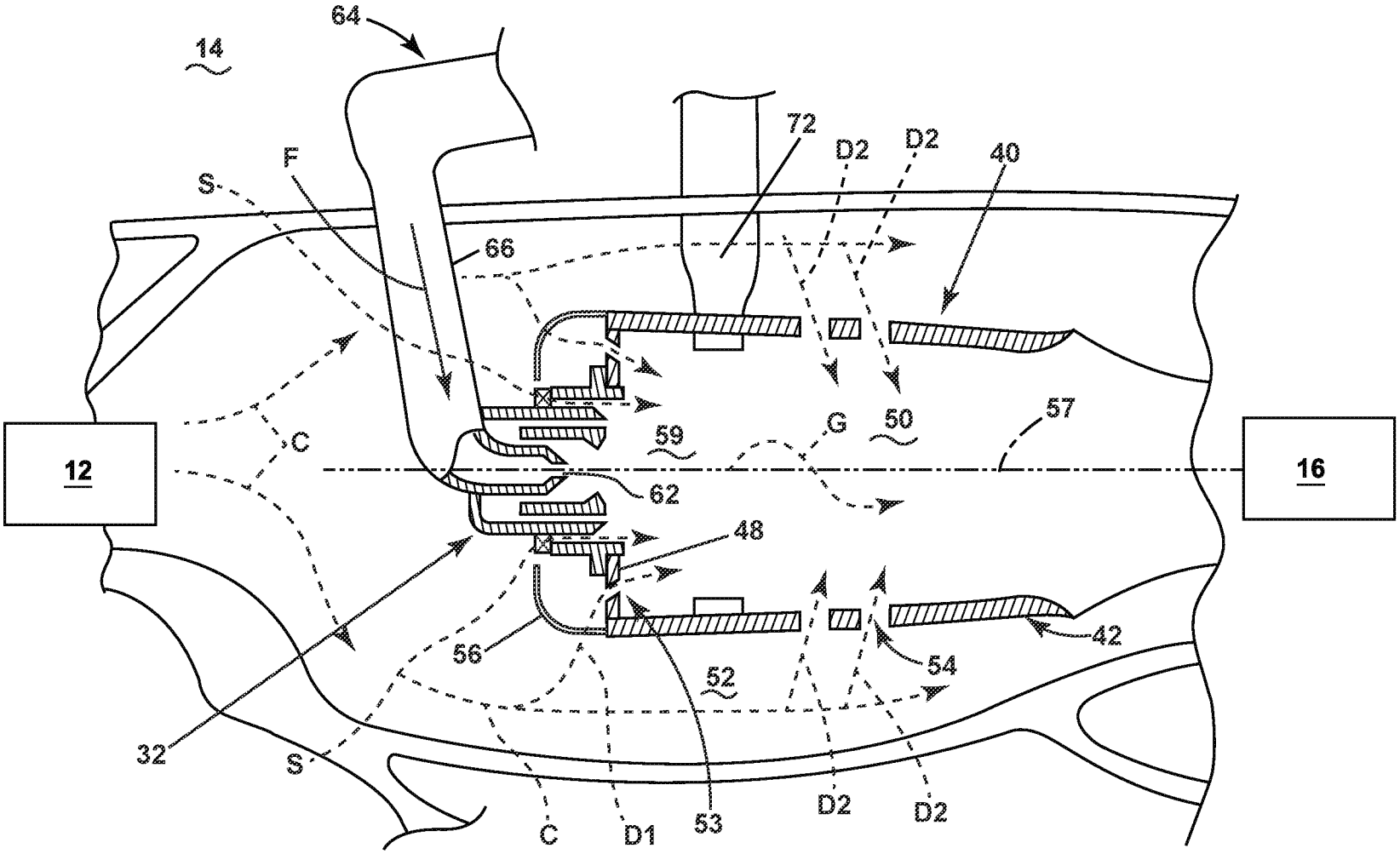
FIG. 4 is FIG. 3 again with some reference numbers removed for clarity and illustrating the combustion section in operation.

Turning to FIG. 4, the combustion section 14 is illustrated with some reference numbers removed for clarity. During operation, a compressed air (denoted "C") from a compressed air supply, such as the LP compressor 22 or the HP compressor 24 of FIG. 1, can flow from the compressor section 12 to the combustor 40. A portion of the compressed air C can flow through the dome assembly 56. A first part of the compressed air C flowing through the dome assembly 56 can be fed to the fuel supply assembly 32 via the swirler 60 as a swirled airflow (denoted "S"). A flow of fuel (denoted "F") is fed to the fuel supply assembly 32 via the fuel inlet 64 and the passageway 66. The swirled airflow S and the flow of fuel F are mixed by the fuel supply assembly 32 and fed to the combustion chamber 50 as a fuel/air mixture. The ignitor 72 can ignite the fuel/air mixture to define a flame within the combustion chamber 50, which generates a combustion gas (denoted "G"). While shown as starting axially downstream of the first fuel outlet 62, it will be appreciated that the fuel/air mixture can be ignited at or near the first fuel outlet 62.

A second part of the compressed air C flowing through one or more portions of the dome assembly 56 can be fed to the set of flame shaping openings 53 as a first dilution airflow (denoted "D1"). That is, a portion of the compressed air C from the compression section 12 can flow through the dome wall 48 and into the combustion chamber 50 by passing through the set of flame shaping openings 53.

Another portion of the compressed air C can flow through the compressed air passageway 52 and can be fed to the second set of downstream dilution openings 54 as a second dilution airflow (denoted "D2"). In other words, another portion of the compressed air C can flow axially past the dome assembly 56 and enter the combustion chamber 50 by passing through the set of downstream dilution openings 54. That is, compressed air C can flow through the combustor liner 42 and into the combustion chamber 50 by passing through the set of downstream dilution openings 54.

The first dilution airflow D1 can be used to direct the combustion gas G and shape the flame in a primary region 59 of the combustion chamber 50 to maintain the dome wall 48 and the combustor liner 42 at a relatively lower temperature. The second dilution airflow D2 can be used to direct and shape the flame to achieve rapid mixing of combustion gases from the primary region 59. It also shapes the flame. In other words, the set of flame shaping openings 53 extending through the dome wall 48 or the set of downstream dilution openings 54 extending through the combustor liner 42 direct air into the combustion chamber 50, where the directed air is used to control, shape, cool, or otherwise contribute to the combustion process in the combustion chamber 50.

The combustor 40 shown in FIG. 4 is well suited for the use of a hydrogen-containing gas as the fuel because it helps contain the faster moving flame front associated with hydrogen fuel, as compared to traditional hydrocarbon fuels. Blends of hydrogen fuel like hydrogen with methane can be used as the fuel. However, the combustor 40 can be used with traditional hydrocarbon fuels.

Figure 5:
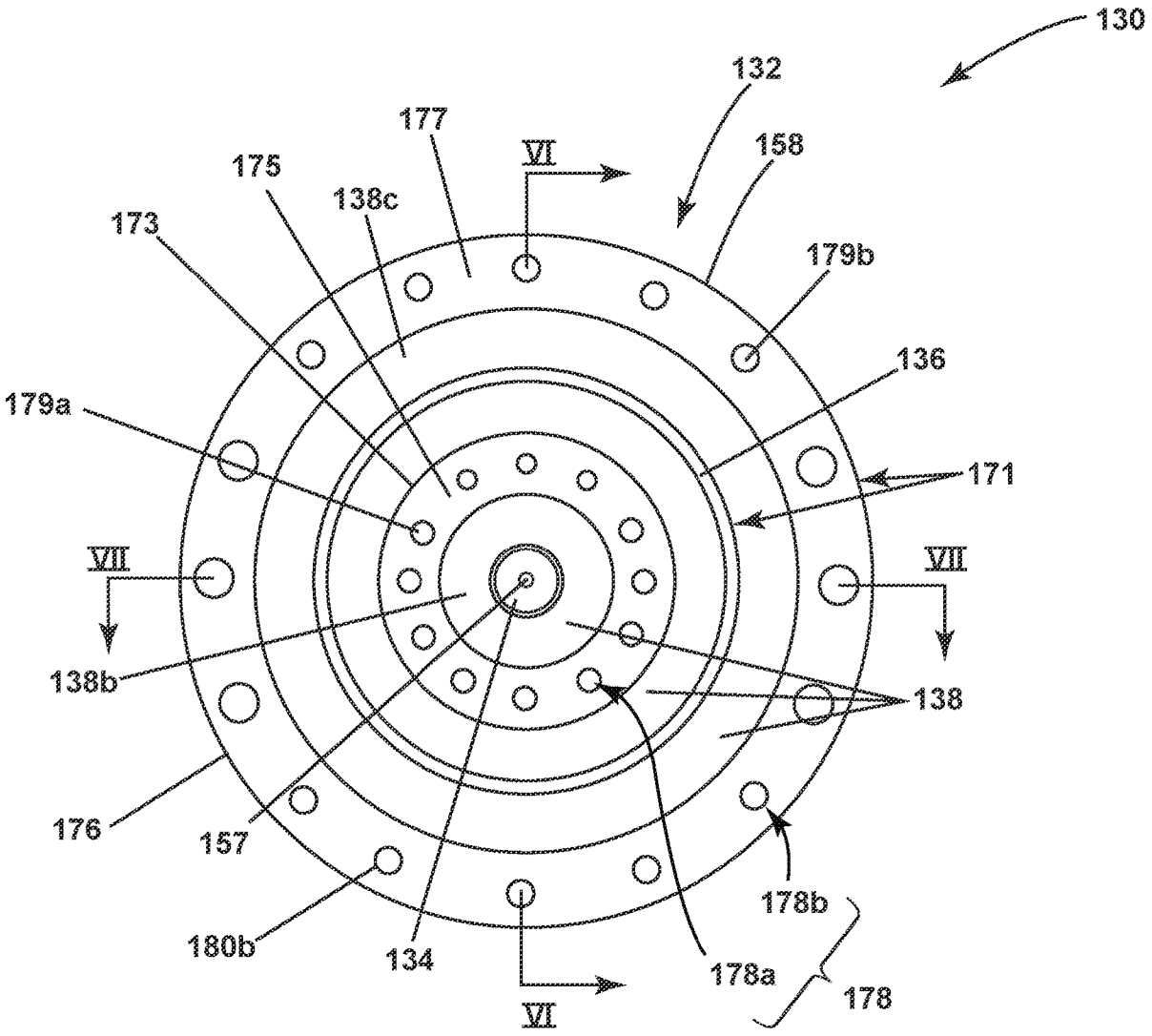
FIG. 5 is an aft, forward looking view of a portion of a fuel supply assembly suitable for use in the combustion section of FIG. 1 according to one aspect of the disclosure herein.

FIG. 5 is an aft, forward-looking view of a fuel supply assembly 132 suitable for use in the combustion section 14 of FIG. 1 as directionally indicated at arrow V of FIG. 3. The fuel supply assembly 132 is similar to the fuel supply assembly 32 (FIG. 2); therefore, like parts will be identified with like names and numerals increased by 100, with it being understood that the description of the fuel supply assembly 32 applies to the fuel supply assembly 132 unless otherwise noted.

The fuel supply assembly 132 can be part of a set of fuel supply assemblies 130 circumferentially arranged about the combustor centerline 29 as illustrated in FIG. 2. The fuel supply assembly 132 includes a fuel nozzle 134, a set of fuel injectors 136, and a series of air injectors 138. The fuel supply assembly 132 is defined by a single monolithic body 158 with a set of concentric walls 171 arranged about a centerline axis 157 and spaced from each other to define the set of fuel injectors 136 and the series of air injectors 138. An inner wall 173 of the set of concentric walls 171 terminates in an inner face 175 and is located between the set of fuel injectors 136 and the fuel nozzle 134 of the fuel supply assembly 132. Likewise, an outer wall 176 of the set of concentric walls 171 terminates in an outer face 177 surrounding an outermost air injector 138*c* of the series of air injectors 138.

The fuel supply assembly 132 includes a series of flame shaping passages 178 including an inner set of flame shaping passages 178*a* formed in the inner wall 173 and circumferentially arranged and distributed evenly about the centerline axis 157. The inner set of flame shaping passages 178*a* each terminate in a set of inner outlets 179*a*. The set of inner outlets 179*a* can have various shapes and sizes, including circular as illustrated.

The series of flame shaping passages 178 further includes an outer set of flame shaping passages 178*b* formed in the outer wall 176 and circumferentially arranged and distributed evenly about the centerline axis 157. The outer set of flame shaping passages 178*b* each terminate in a set of outer outlets 179*b*. The set of outer outlets 179*b* can have various shapes and sizes, including circular as illustrated.

Figure 6:
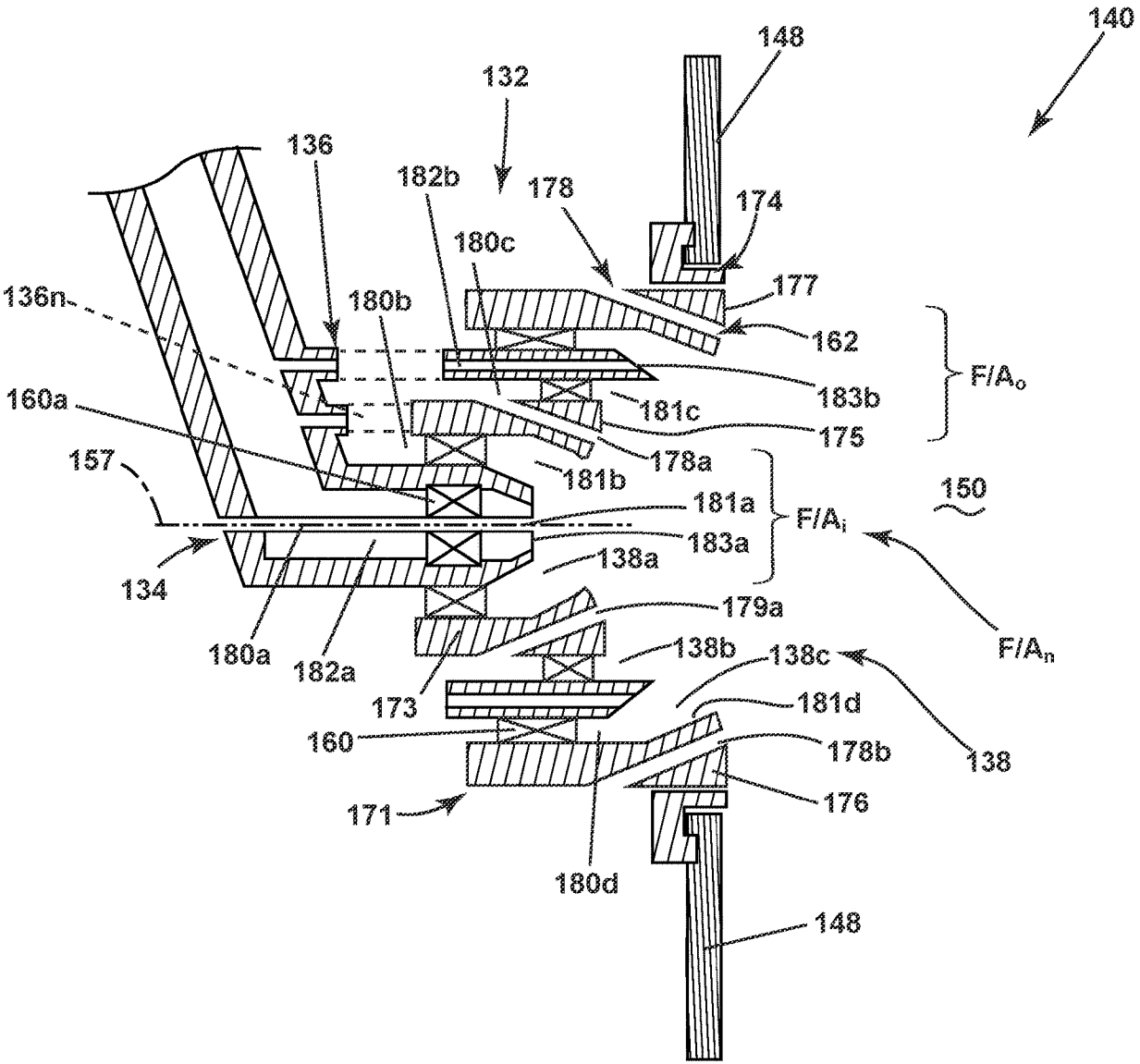
FIG. 6 is an enlarged schematic cross-sectional view taken along line VI-VI of FIG. 5 illustrating a portion of a fuel supply assembly from FIG. 5.

FIG. 6 is a cross-section taken along line VI-VI of FIG. 5 in a side view. The fuel supply assembly 132 is fluidly connected to a combustor 140 and more specifically a combustion chamber 150 of the combustor 140. A dome wall 148 at least partially defines the combustion chamber 150 and includes an opening 174 through which the fuel supply assembly 132 is received.

The series of flame shaping passages 178 are defined by the set of concentric walls 171 and can be formed within the set of concentric walls 171 to be angled inward toward the centerline axis 157 to define a set of angled flame shaping passages 162. In one aspect both the inner set of flame shaping passages 178*a* and the outer set of flame shaping passages 178*b* include sets of angled flame shaping passages 162.

The series of air injectors 138 can be multiple air injectors 138 circumscribing the fuel nozzle 134. Likewise, the set of fuel injectors 136 can be multiple fuel injectors 136 interspersed within the series of air injectors 138. In one non-limiting example the set of fuel injectors are located between sequential air injectors 138. Any number of fuel injectors 136*n* is contemplated as illustrated in dashed line, where corresponding air outlets and fuel outlets define any number of fuel/air circuits F/An.

In one aspect, the fuel nozzle 134 includes a first air supply conduit 180*a* terminating in a first air outlet 181*a*, and extending along the centerline axis 157. A first fuel supply conduit 182*a* can surround the first air supply conduit 180*a*. The first fuel supply conduit 182*a* terminates in a first fuel outlet 183*a*. The first fuel outlet 183*a* can be annular about the first air outlet 181*a*. It is further contemplated that the first fuel outlet 183*a* provides a discontinuous supply of fuel. By way of non-limiting example, many small and/or discrete openings can define the first fuel outlet 183*a*.

The series of air injectors 138 can include an innermost air injector 138*a* surrounding the fuel nozzle 134 and at least partially defined by the inner wall 173. The inner set of flame shaping passages 178*a* can extend through the inner wall 173 with the set of inner outlets 179*a* exhausting downstream of the innermost air injector 138*a*. In one aspect the innermost air injector 138*a* comprises a second air supply conduit 180*b* terminating in a second air outlet 181*b*, and circumscribing the centerline axis 157. Together the fuel nozzle 134 along with the inner set of flame shaping passages 178*a* and the innermost air injector 138*a* defines an inner fuel/air circuit (denoted "$F/A_i$"). At least one swirler 160, referred to herein as a first swirler 160*a*, can be provided in the fuel nozzle 134. The first swirler 160*a* is associated with the inner fuel/air circuit $F/A_i$.

The series of air injectors 138 can include an intermediate air injector 138*b* surrounding the inner set of flame shaping passages 178*a*. In one aspect the intermediate air injector 138*b* comprises a third air supply conduit 180*c* terminating in a third air outlet 181*c*, and circumscribing the centerline axis 157.

A second fuel supply conduit 182*b* can surround the third air supply conduit 180*c*. The second fuel supply conduit 182*b* terminates in a second fuel outlet 183*b*. The second fuel outlet 183*b* can be annular about the third air outlet 181*c*. It is further contemplated that the second fuel outlet 183*b* provides a discontinuous supply of fuel, by way of non-limiting example many small and/or discrete openings can define the second fuel outlet 183*b*.

An outermost air injector 138*c* can surround the second fuel supply conduit 182*b* and be at least partially defined by the outer wall 176. In one aspect the outermost air injector 138*c* comprises a fourth air supply conduit 180*d* terminating in a fourth air outlet 181*d*, and circumscribing the centerline axis 157. In other words, the intermediate air injector 138*b* and the outermost air injector 138*c* sandwich the second fuel supply conduit 182*b*. The outer set of flame shaping passages 178*b* can extend through the outer wall 176 with the set of outer outlets 179*b* exhausting downstream of the outermost air injector 138*c*. Further, at least one swirler 160 can be provided in at least one of the air injectors in the series of air injectors 138. By way of non-limiting example, a swirler 160 is located in all of the air injectors in the series of air injectors 138 as illustrated. Together the second fuel supply conduit 182*b* along with the outer set of flame shaping passages 178*b*, the intermediate air injector 138*b*, and the outermost air injector 138*c* defines an outer fuel/air circuit (denoted "$F/A_o$").

Figure 7:
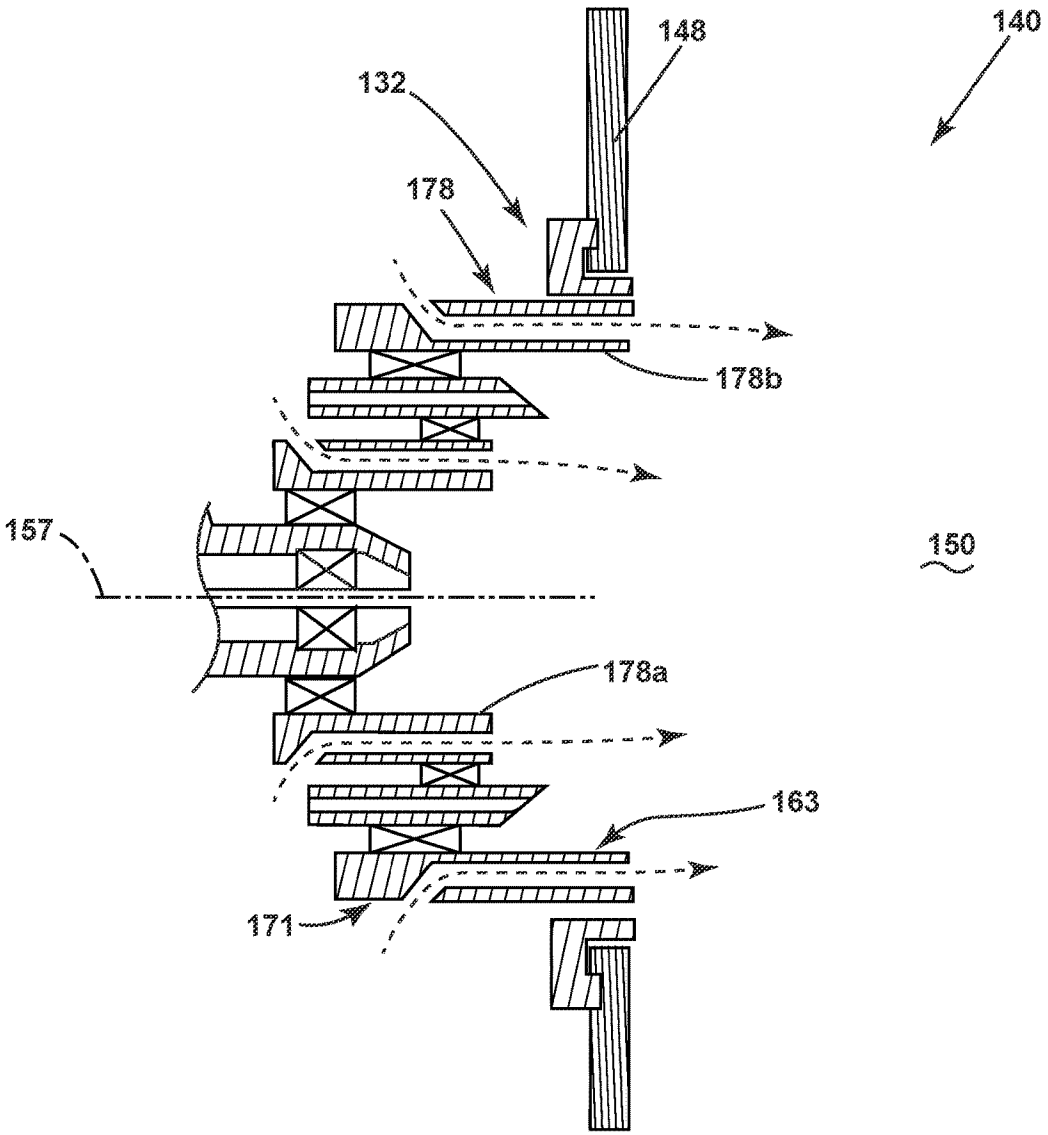
FIG. 7 is an enlarged schematic cross-sectional view taken along line VII-VII of FIG. 5 of a portion of a fuel supply assembly from FIG. 5.

FIG. 7 is a cross-section taken along line VII-VII of FIG. 5 illustrating the fuel supply assembly 132 in a top-down view. The series of flame shaping passages 178 are defined by the set of concentric walls 171 and can be formed within the set of concentric walls 171 to extend in an axial direction parallel to the centerline axis 157 to define a set of axial flame shaping passages 163. In one aspect both the inner set of flame shaping passages 178*a* and the outer set of flame shaping passages 178*b* include sets of axial flame shaping passages 163, where every other flame shaping passage is either the set of axial flame shaping passages 163 or the set of angled flame shaping passages 162 (FIG. 6).

Figure 8:
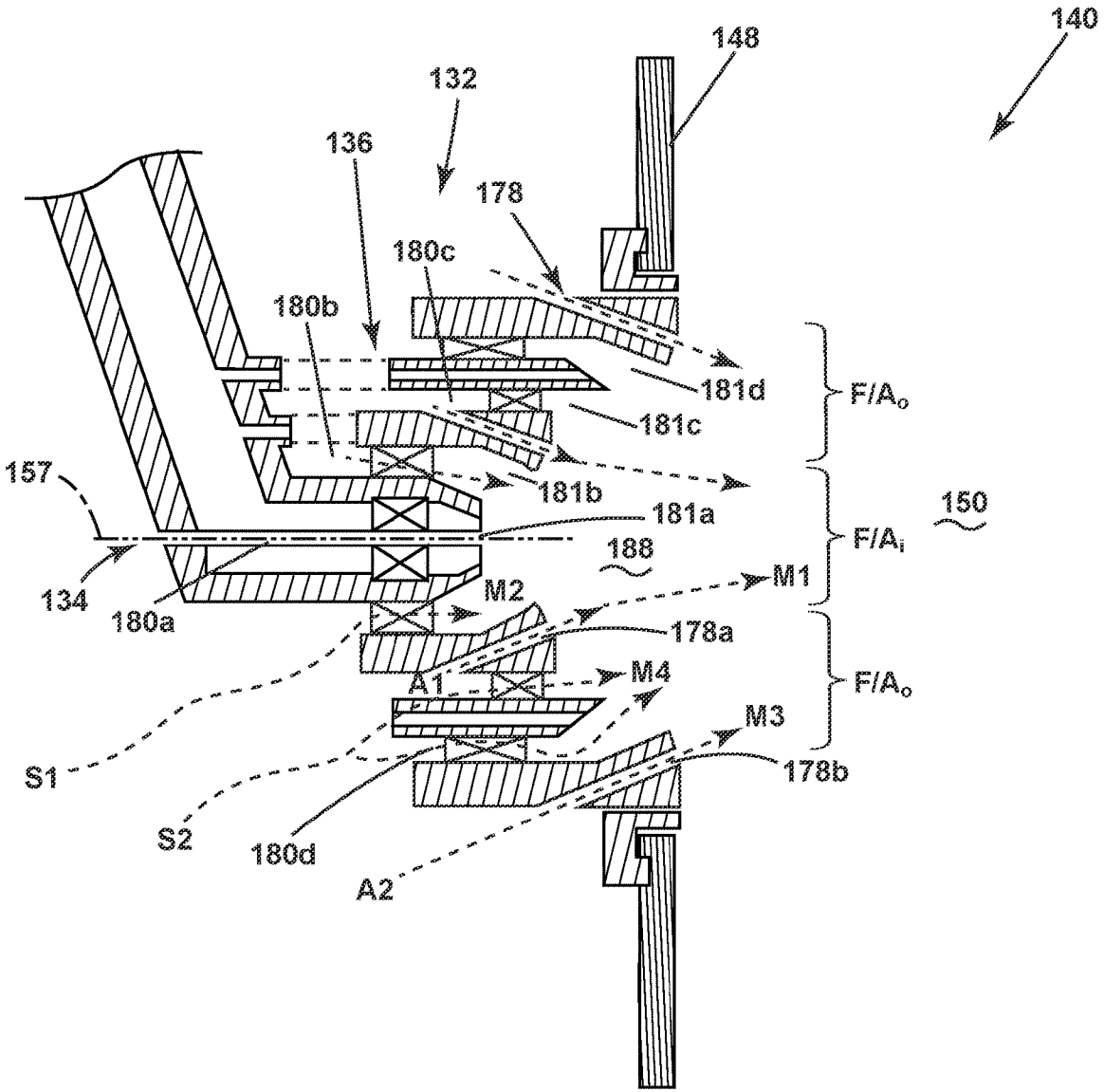
FIG. 8 is the enlarged schematic cross-sectional view of FIG. 6 illustrating airflow through the fuel supply assembly.

Turning to FIG. 8, the cross-sectional view from FIG. 6 is illustrated with reference numbers removed for clarity to illustrate the fuel supply assembly 132 in operation. The fuel nozzle 134 introduces a fuel/air mixture to produce a flame within the combustion chamber 150, which generates combustion gases G (FIG. 4). The inner set of flame shaping passages 178*a* are formed to control the flame shape in a central region 188 of the combustion chamber 150. The inner set of flame shaping passages 178*a* prevent hot gases from expanding over larger areas which reduces NOx emissions. The inner set of flame shaping passages 178*a* also prevent durability issues for the outer fuel/air circuit $F/A_o$ by controlling outward spread of hot gases. The outer set of flame shaping passages 178*b* shape the overall flame structure within the combustion chamber 150. Further the outer set of flame shaping passages 178*b* enable better durability for the dome wall 148 and the combustor liner (not illustrated, see FIG. 3).

The inner set of flame shaping passages 178*a* are formed to provide a first flow of air (denoted "A1") with a first momentum (denoted "M1") for controlling expansion of the swirled airflow S (FIG. 4) exhausting from the inner fuel/air circuit $F/A_i$. A first total swirled airflow (denoted "S1") exhausts from the second air outlet 181*b* with a second momentum (denoted "M2"). The inner set of flame shaping passages 178*a* prevent the first total swirled airflow S1 from impacting flow from the outer fuel/air circuit $FA_o$ while remaining effective in controlling flame structure in the central region 188. A ratio between the first momentum M1 and the second momentum M2 (M1:M2) ranges from 0.2 to 3.

In yet another aspect the first flow of air A1 is 0.1 to 1.5 times the first total swirled airflow S1 ($0.1S1 \leq A1 \leq 1.5S1$). In other words, the inner set of flame shaping passages 178*a* allow for the first flow of air A1 to be 0.1 to 1.5 times of the total amount of air combinedly flowing through the first air supply conduit 180*a* and the second air supply conduit 180*b* and exhausting from the first air outlet 181*a* and the second air outlet 181*b*.

The outer set of flame shaping passages 178*b* are formed to provide a second flow of air (denoted "A2") with a third momentum (denoted "M3") for controlling the flame shape from outer fuel/air circuit $F/A_o$ and for preventing hot gasses from expanding toward the combustor liner (not illustrated, see FIG. 3) and dome wall 148. In one aspect the third momentum M3 is greater than the first momentum M1 (M1<M3). It is further contemplated that the first momentum M1 is greater than the third momentum M3 (M1>M3), or that the first momentum M1 is equal to the third momentum M3 (M1=M3). A second total swirled airflow (denoted "S2") exhausts from the third and fourth air outlets 181*c*, 181*d* with a fourth momentum (denoted "M4"). A ratio between the third momentum M3 and the fourth momentum M4 (M3:M4) ranges from 0.4 to 4.

In yet another aspect, the second flow of air A2 is 0.1 to 2.0 times the second total swirled airflow S2 ($0.1S2 \leq A2 \leq 2.0S2$). In other words, the outer set of flame shaping passages 178*b* allow for the second flow of air A2 to be 0.1 to 2 times an amount of air flowing combinedly through the third air supply conduit 180*c* and the fourth air supply conduit 180*d* and exhausting from the third air outlet 181*c* and the fourth air outlet 181*d*.

In another aspect the amount of air and fuel in the inner fuel/air circuit $F/A_i$ is smaller than the amount of air and fuel in the outer fuel/air circuit $F/A_o$.

The flame shaping passages described herein enable significant higher flow than that of a typical dilution hole in a dome wall. The inner set of flame shaping passages 178*a* can allow 5% to 45% of a total swirled airflow (S1+S2) therethrough. The outer set of flame shaping passages 178*b* can allow 10% to 55% of the total swirled airflow (S1+S2).

Figure 9:
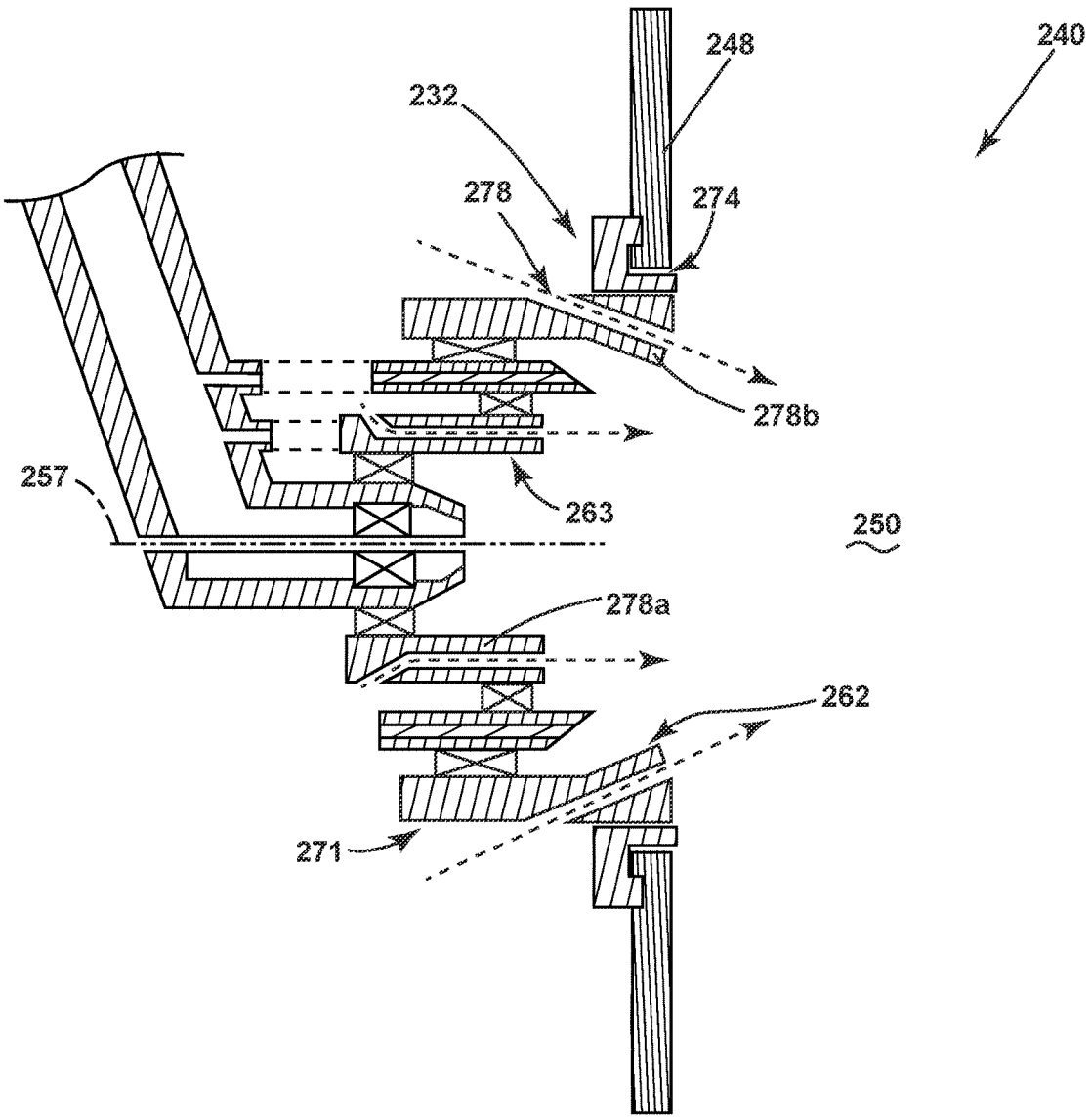
FIG. 9 is an enlarged schematic side cross-sectional view of a portion of a fuel supply assembly suitable for use in the combustion section of FIG. 1 according to another aspect of the disclosure herein.

FIG. 9 is a cross-sectional view of a fuel supply assembly 232 suitable for use in the combustion section 14 of FIG. 1 and similar to the cross-sectional view of FIG. 5. The fuel supply assembly 232 is similar to the fuel supply assembly 132 (FIG. 5); therefore, like parts will be identified with like names and numerals increased by 100, with it being understood that the description of the fuel supply assembly 132 applies to the fuel supply assembly 232 unless otherwise noted.

The fuel supply assembly 232 is fluidly connected to a combustor 240 and more specifically a combustion chamber 250 of the combustor 240. A dome wall 248 at least partially defines the combustion chamber 250 and includes an opening 274 through which the fuel supply assembly 232 is received.

A series of flame shaping passages 278 are defined by a set of concentric walls 271 and can include an inner set of flame shaping passages 278*a* and an outer set of flame shaping passages 278*b*. The inner set of flame shaping passages 278*a* can be formed within the set of concentric walls 271 to extend in an axial direction parallel to a centerline axis 257 to define a set of axial flame shaping passages 263. The outer set of flame shaping passages 278*b* can be formed within the set of concentric walls 271 to be angled inward toward the centerline axis 257 to define a set of angled flame shaping passages 262.

Figure 10:
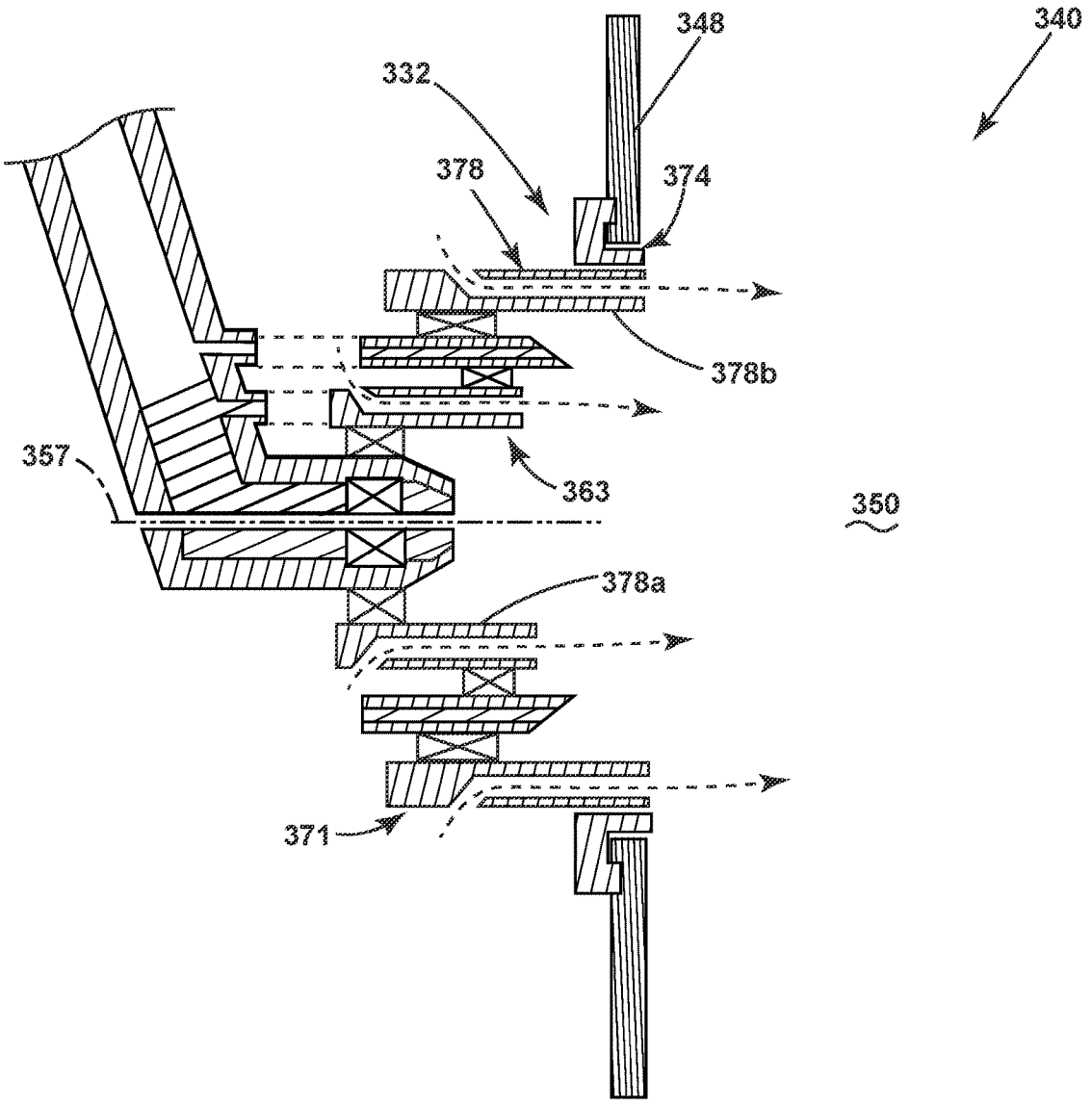
FIG. 10 is an enlarged schematic side cross-sectional view of a portion of a fuel supply assembly suitable for use in the combustion section of FIG. 1 according to another aspect of the disclosure herein.

FIG. 10 is a cross-sectional view of a fuel supply assembly 332 suitable for use in the combustion section 14 of FIG. 1 and similar to the cross-sectional view of FIG. 5. The fuel supply assembly 332 is similar to the fuel supply assembly 132 (FIG. 5); therefore, like parts will be identified with like names and numerals increased by 200, with it being understood that the description of the fuel supply assembly 132 applies to the fuel supply assembly 332 unless otherwise noted.

The fuel supply assembly 332 is fluidly connected to a combustor 340 and more specifically a combustion chamber 350 of the combustor 340. A dome wall 348 at least partially defines the combustion chamber 350 and includes an opening 374 through which the fuel supply assembly 332 is received.

A series of flame shaping passages 378 are defined by a set of concentric walls 371 and can include an inner set of flame shaping passages 378*a* and an outer set of flame shaping passages 378*b*. The inner set of flame shaping passages 378*a* and the outer set of flame shaping passages 378*b* can both be formed within the set of concentric walls 371 to extend in an axial direction parallel to a centerline axis 357 to define a set of axial flame shaping passages 363.

Figure 11:
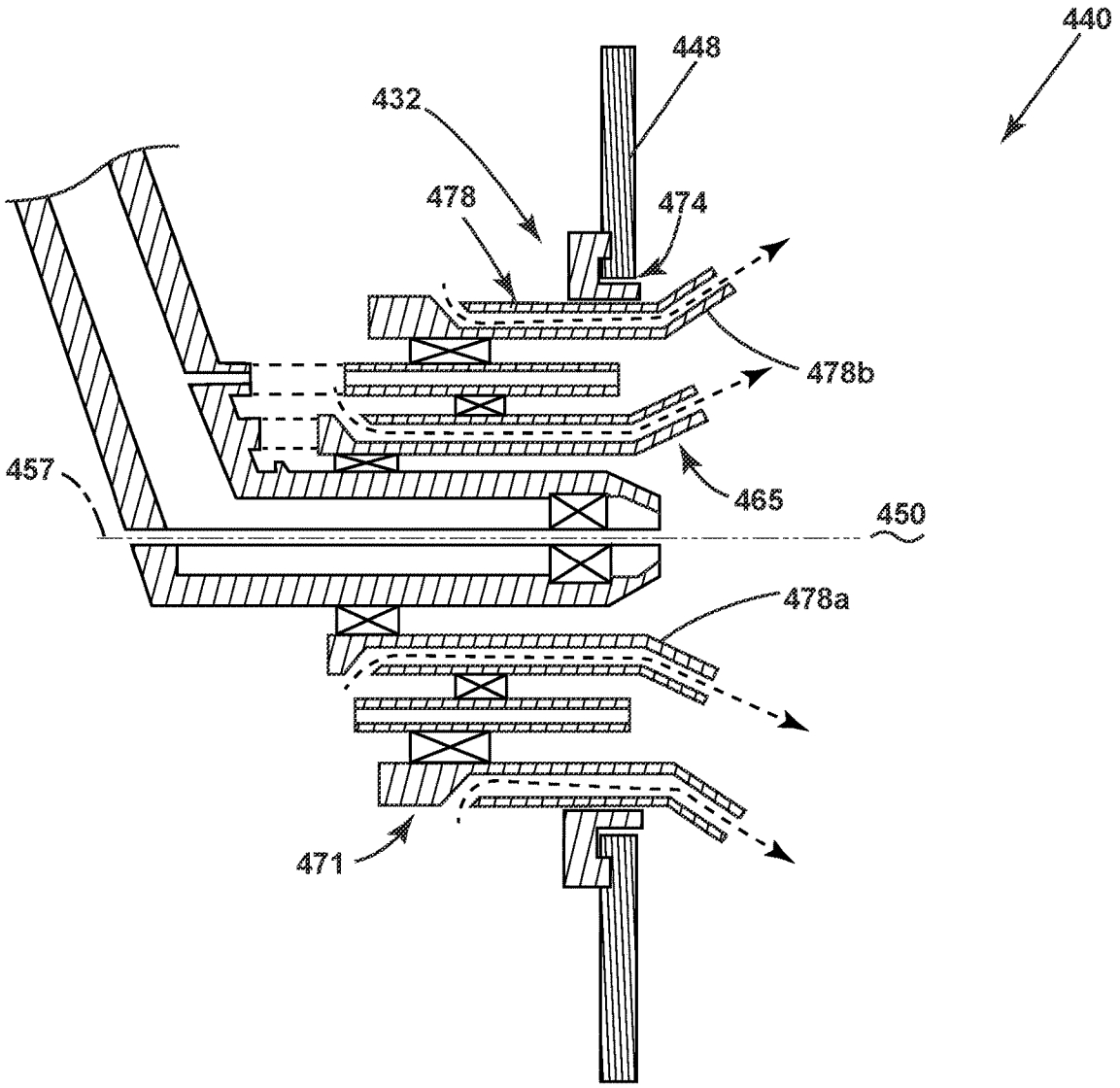
FIG. 11 is an enlarged schematic side cross-sectional view of a portion of a fuel supply assembly suitable for use in the combustion section of FIG. 1 according to another aspect of the disclosure herein.

FIG. 11 is a cross-sectional view of a fuel supply assembly 432 suitable for use in the combustion section 14 of FIG. 1 and similar to the cross-sectional view of FIG. 5. The fuel supply assembly 432 is similar to the fuel supply assembly 132 (FIG. 5); therefore, like parts will be identified with like names and numerals increased by 300, with it being understood that the description of the fuel supply assembly 132 applies to the fuel supply assembly 432 unless otherwise noted.

The fuel supply assembly 432 is fluidly connected to a combustor 440 and more specifically a combustion chamber 450 of the combustor 440. A dome wall 448 at least partially defines the combustion chamber 450 and includes an opening 474 through which the fuel supply assembly 432 is received.

A series of flame shaping passages 478 are defined by set of concentric walls 471 and can include an inner set of flame shaping passages 478*a* and an outer set of flame shaping passages 478*b*. The inner set of flame shaping passages 478*a* and the outer set of flame shaping passages 478*b* can both be formed within the set of concentric walls 471 to extend first in an axial direction parallel to a centerline axis 457 and then in an angled direction away from the centerline axis 457 to define a hybrid set of flame shaping passages 465.

Figure 12:
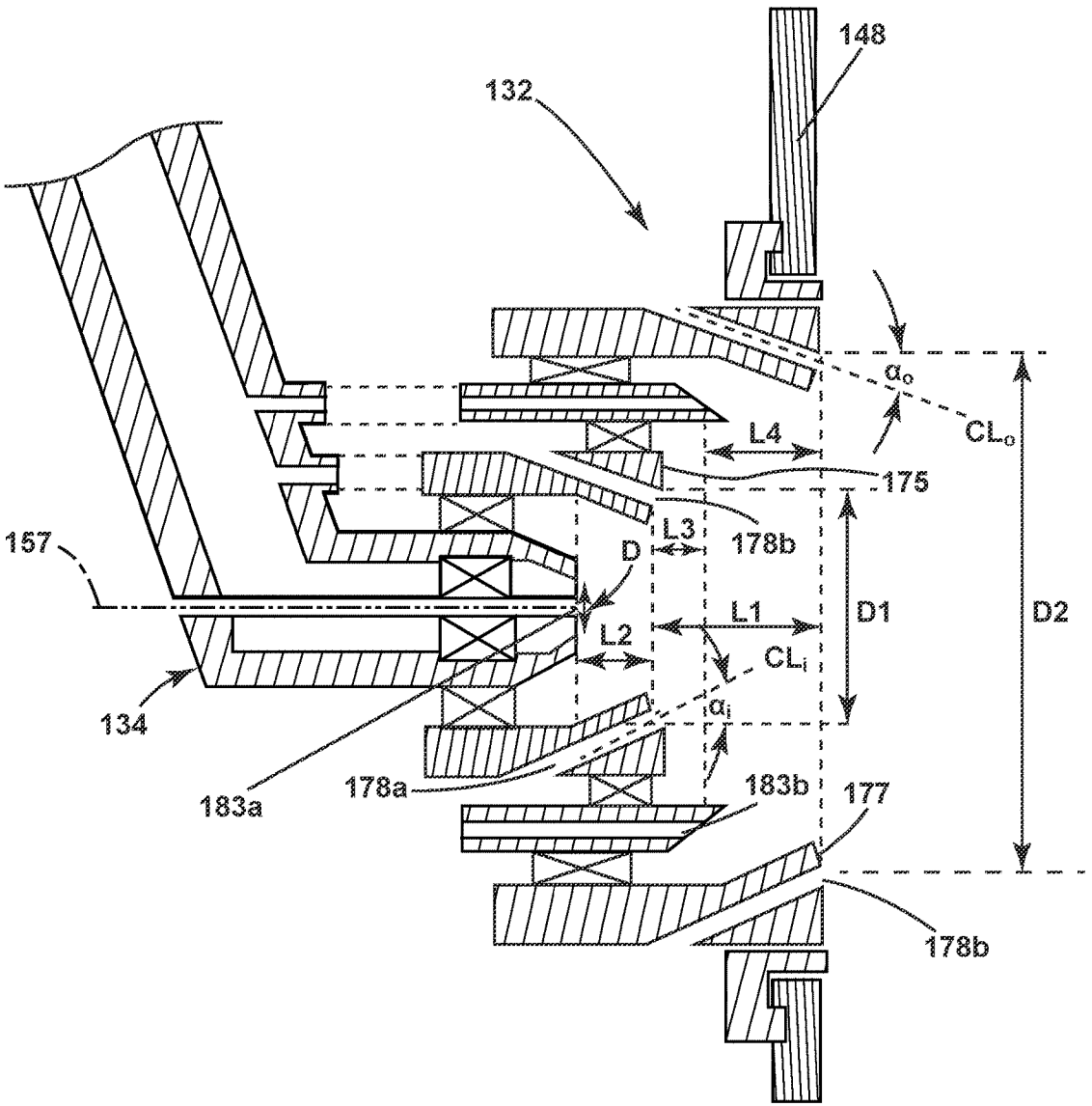
FIG. 12 is an enlarged schematic side cross-sectional view of a portion of a fuel supply assembly suitable for use in the combustion section of FIG. 1 according to another aspect of the disclosure herein and illustrating possible dimensions for any of the fuel supply assemblies disclosed herein.

FIG. 12 is the fuel supply assembly 132 from FIG. 6 illustrating dimensions for any of the supply assemblies 132, 232, 332, 432 described herein. A diameter (denoted "D") is defined as the outer diameter of the fuel nozzle 134 at the first fuel outlet 183*a*. A first length (denoted "L1") is measured along the centerline axis 157 from the inner face 175 to the outer face 177. The first length L1 ranges from 0 to 20D. A second length (denoted "L2") is measured along the centerline axis 157 from the inner face 175 to the first fuel outlet 183*a* the second length L2 ranges from 0 to 20D. A third length (denoted "L3") is measured along the centerline axis 157 from the inner face 175 to the second fuel outlet 183*b*. The third length L3 ranges from −20D to 20D. A fourth length (denoted "L4") is measured along the centerline axis 157 from the outer face 177 to the second fuel outlet 183*b*. The fourth length L3 ranges from −20D to 20D.

A first diameter (denoted "D1") is the diameter associated with the inner set of flame shaping passages 178*a*. The first diameter D1 ranges from 1.2D to 30D. A second diameter (denoted "D2") is the diameter associated with the outer set of flame shaping passages 178*b*. The second diameter D2 ranges from 2D to 40D.

The inner set of flame shaping passages 178*a* define an inner passage centerline (denoted "$CL_i$") that forms an inner angle (denoted $\alpha_i$) with the centerline axis 157. The outer set of flame shaping passages 178*b* define an outer passage centerline (denoted "$CL_o$") that forms an outer angle (denoted $\alpha_o$) with the centerline axis 157. Both of the inner and outer angles ($\alpha_i$, $\alpha_o$) range from −70 degrees to +70 degrees.

Figure 13:
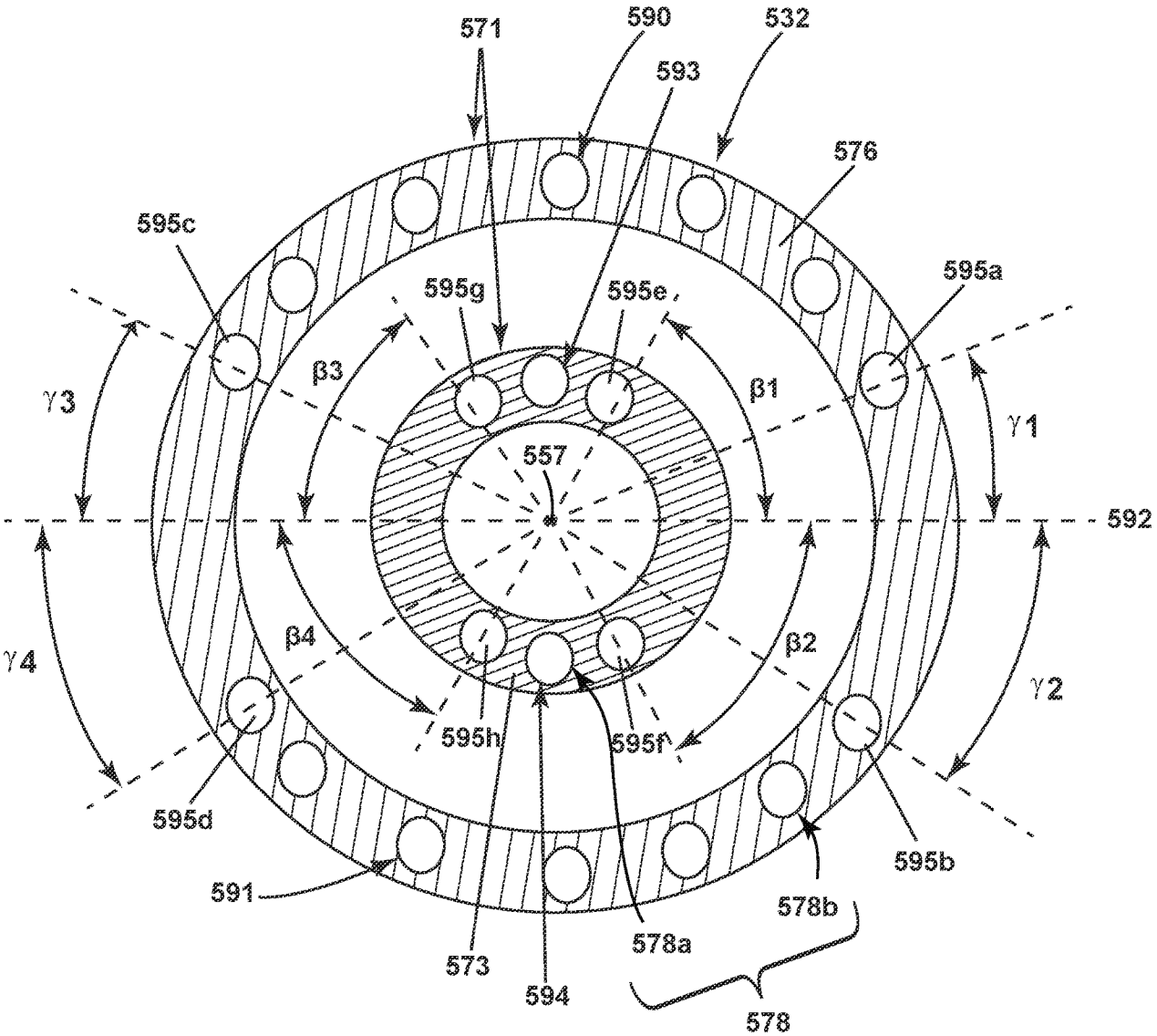
FIG. 13 is an enlarged schematic front cross-sectional view of a portion of a fuel supply assembly suitable for use in the combustion section of FIG. 1 according to another aspect of the disclosure herein.

FIG. 13 is a cross section taken along a radial plane of a fuel supply assembly 532 suitable for use in the combustion section 14 of FIG. 1. The fuel supply assembly 532 is similar to the fuel supply assembly 132 (FIG. 5); therefore, like parts will be identified with like names and numerals increased by 400, with it being understood that the description of the fuel supply assembly 132 applies to the fuel supply assembly 532 unless otherwise noted.

The fuel supply assembly 532 is includes a set of concentric walls 571 that are shown in cross-section. Other parts of the fuel supply assembly 532 are removed for clarity. The set of concentric walls 571 are arranged about a centerline axis 557 and radially spaced from each other. The set of concentric walls 571 includes a series of flame shaping passages 578. An inner wall 573 in the set of concentric walls 571 includes an inner set of flame shaping passages 578*a* circumferentially arranged about the centerline axis 557. An outer wall 576 in the set of concentric walls 571 includes an outer set of flame shaping passages 578*b* circumferentially arranged about the centerline axis 557. The inner set of flame shaping passages 578*a* and the outer set of flame shaping passages 578*b* can have various shapes and sizes, including oval as illustrated.

The outer set of flame shaping passages 578*b* include a first upper set of flame shaping passages 590 and a first lower set of flame shaping passages 591 separated by a mid-line axis 592 intersecting the centerline axis 557. The inner set of flame shaping passages 578*a* includes a second upper set of flame shaping passages 593 and a second lower set of flame shaping passages 594 separated by the mid-line axis 592 intersecting the centerline axis 557.

The first upper set of flame shaping passages 590 includes a first closest discrete flame shaping passage 595*a* spaced from the mid-line axis 592 a first outer spacing angle (denoted "γ1"). The first lower set of flame shaping passages 591 includes a second closest discrete flame shaping passage 595*b* spaced from the mid-line axis 592 a second outer spacing angle (denoted "γ2"). The first upper set of flame shaping passages 590 includes a third closest discrete flame shaping passage 595*c* spaced from the mid-line axis 592 a third outer spacing angle (denoted "γ3"). The first lower set of flame shaping passages 591 includes a fourth closest discrete flame shaping passage 595*d* spaced from the mid-line axis 592 a fourth outer spacing angle (denoted "γ4").

The second upper set of flame shaping passages 593 includes a fifth closest discrete flame shaping passage 595*e* spaced from the mid-line axis 592 a first inner spacing angle (denoted "β1"). The second lower set of flame shaping passages 594 includes a sixth closest discrete flame shaping passage 595*f* spaced from the mid-line axis 592 a second inner spacing angle (denoted "β2"). The second upper set of flame shaping passages 593 includes a seventh closest discrete flame shaping passage 595*g* spaced from the mid-line axis 592 a third inner spacing angle (denoted "β3"). The second lower set of flame shaping passages 594 includes an eighth closest discrete flame shaping passage 595*h* spaced from the mid-line axis 592 a fourth inner spacing angle (denoted "β4").

The set of concentric walls 571 do not include flame shaping passages within the spaces defined by the spacing angles (γ1, γ2, γ3, γ4, β1, β2, β3, β4). The spacing angles range from 0 to 70 degrees.

The set of concentric walls 571 are free of passages in certain locations to allow for interaction between the inner and outer fuel/air circuits $F/A_i$, $F/A_o$(FIGS. 6 and 8) for flame propagation, ignition or to establish interaction between circuits. Further the passages can be removed from the outer wall 576 to allow for flame propagation between sequential fuel supply assemblies and to meet a desired combustor exit temperature profile and pattern.

Figure 14:
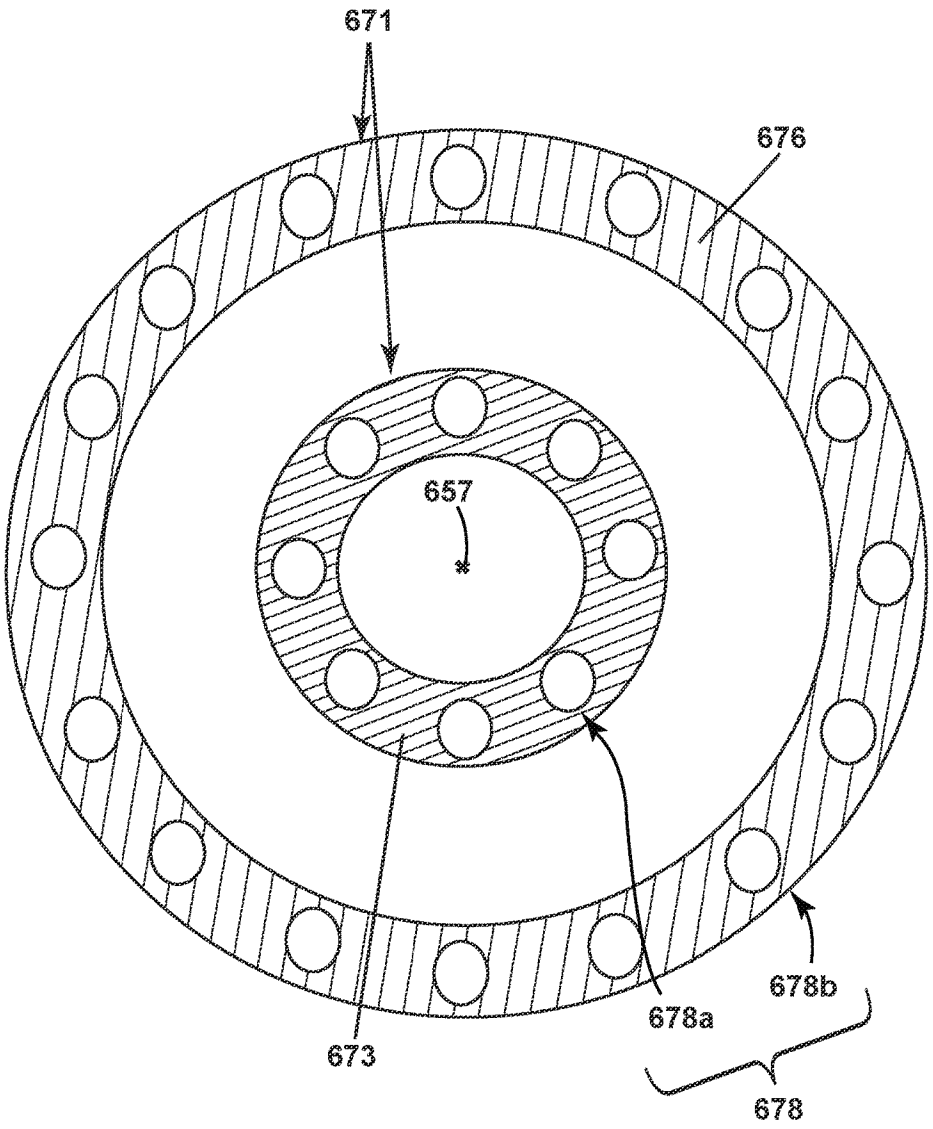
FIG. 14 is an enlarged schematic front cross-sectional view of a portion of a fuel supply assembly suitable for use in the combustion section of FIG. 1 according to another aspect of the disclosure herein.

FIG. 14 is another embodiment of the cross section of FIG. 13 with a set of concentric walls 671 including a series of flame shaping passages 678. An inner wall 673 in the set of concentric walls 671 includes an inner set of flame shaping passages 678*a* evenly arranged circumferentially about a centerline axis 657. An outer wall 676 in the set of concentric walls 671 includes an outer set of flame shaping passages 678*b* evenly arranged circumferentially about the centerline axis 657. The inner set of flame shaping passages 678*a* and the outer set of flame shaping passages 678*b* can have various shapes and sizes, including oval as illustrated.

Figure 15:
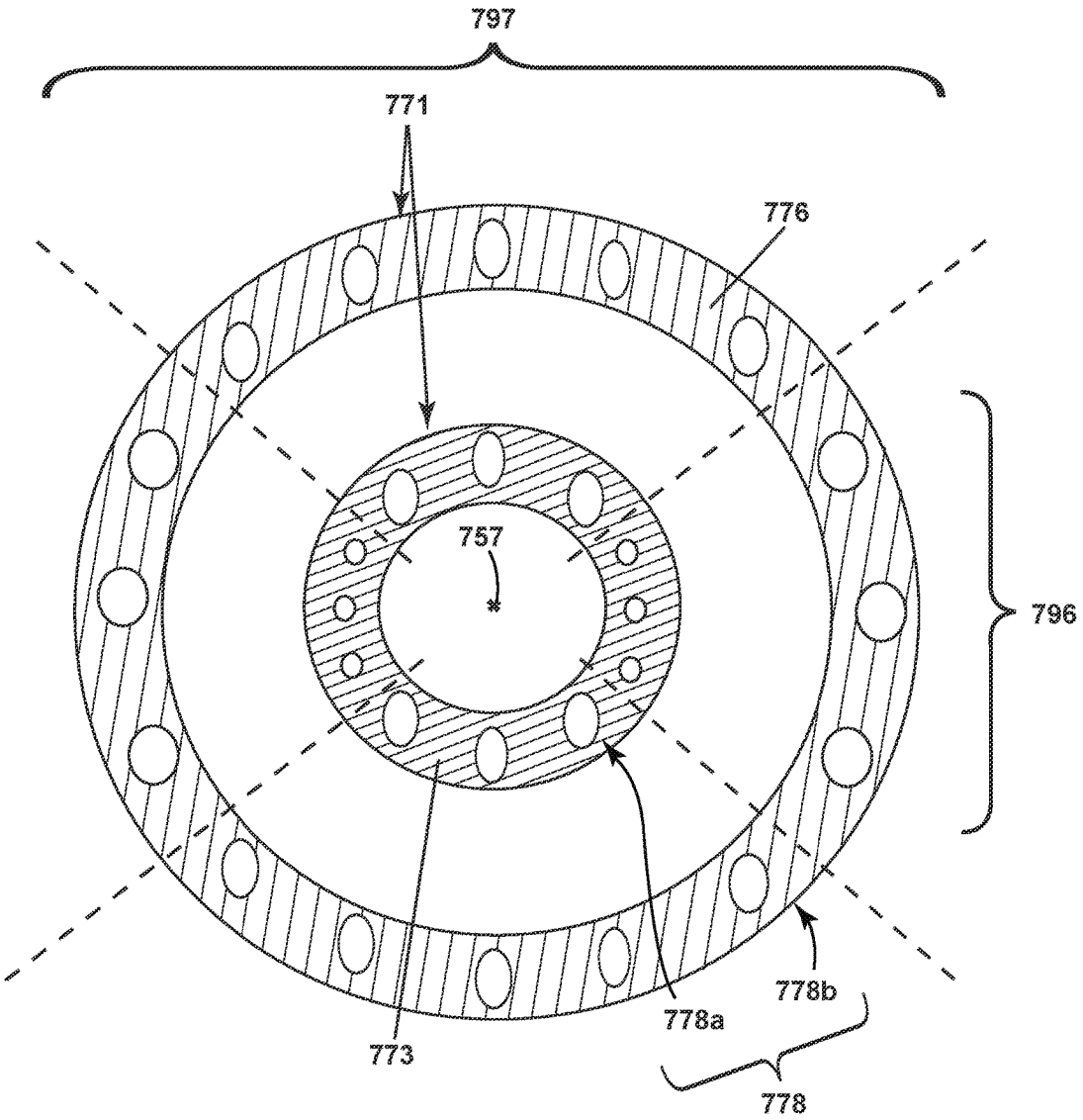
FIG. 15 is an enlarged schematic front cross-sectional view of a portion of a fuel supply assembly suitable for use in the combustion section of FIG. 1 according to another aspect of the disclosure herein.

FIG. 15 is another embodiment of the cross section of FIG. 13 with a set of concentric walls 771 including a series of flame shaping passages 778. An inner wall 773 in the set of concentric walls 771 includes an inner set of flame shaping passages 778*a* evenly arranged circumferentially about a centerline axis 757. An outer wall 776 in the set of concentric walls 771 includes an outer set of flame shaping passages 778*b* evenly arranged circumferentially about the centerline axis 757. The inner set of flame shaping passages 778*a* and the outer set of flame shaping passages 778*b* both include a middle set of flame shaping passages 796 with a circular shape. In one example, the middle set of flame shaping passages 796 for the inner set of flame shaping passages 778*a* are smaller than the middle set of flame shaping passages 796 for the outer set of flame shaping passages 778*b*. The inner set of flame shaping passages 778*a* and the outer set of flame shaping passages 778*b* both include opposing sets of flame shaping passages 797 with an oval shape. This elongated shape can contribute to flame shaping.

Figure 16:
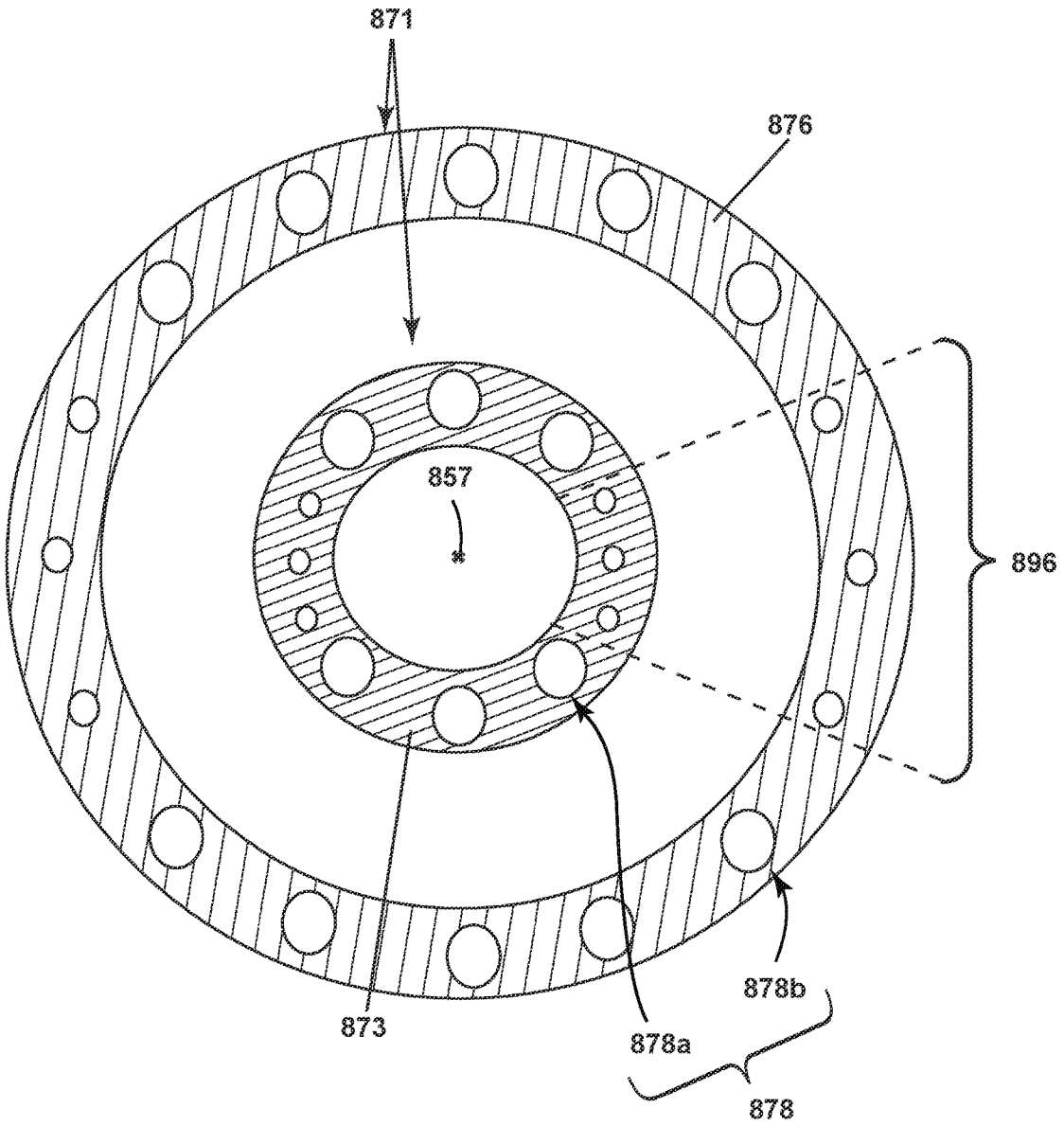
FIG. 16 is an enlarged schematic front cross-sectional view of a portion of a fuel supply assembly suitable for use in the combustion section of FIG. 1 according to another aspect of the disclosure herein.

FIG. 16 is another embodiment of the cross section of FIG. 13 with a set of concentric walls 871 including a series of flame shaping passages 878. An inner wall 873 in the set of concentric walls 871 includes an inner set of flame shaping passages 878*a* evenly arranged circumferentially about a centerline axis 857. An outer wall 876 in the set of concentric walls 871 includes an outer set of flame shaping passages 878*b* evenly arranged circumferentially about the centerline axis 857. The inner set of flame shaping passages 878*a* and the outer set of flame shaping passages 878*b* both include a middle set of flame shaping passages 896 that are smaller in size than the remaining flame shaping passages 878.

Figure 17:
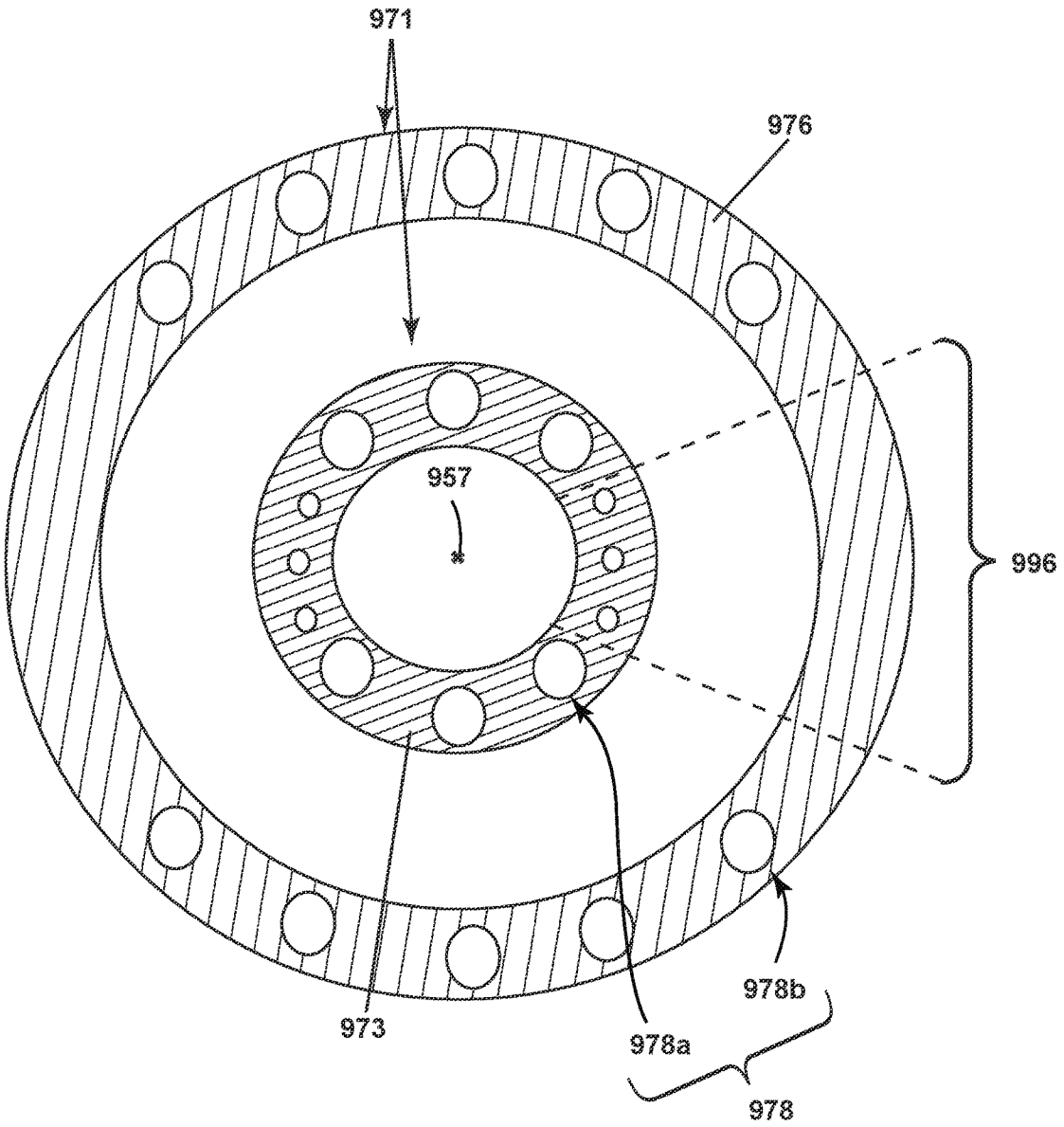
FIG. 17 is an enlarged schematic front cross-sectional view of a portion of a fuel supply assembly suitable for use in the combustion section of FIG. 1 according to another aspect of the disclosure herein.

FIG. 17 is another embodiment of the cross section of FIG. 13 with a set of concentric walls 971 including a series of flame shaping passages 978. An inner wall 973 in the set of concentric walls 971 includes an inner set of flame shaping passages 978*a* arranged circumferentially about a centerline axis 657. An outer wall 976 in the set of concentric walls 971 includes an outer set of flame shaping passages 978*b* evenly arranged circumferentially about the centerline axis 957. Similar to the cross-section of FIG. 15, only the inner set of flame shaping passages 978*a* include a middle set of flame shaping passages 996 that are smaller in size than the remaining flame shaping passages. A smaller flame shaping hole size in the lateral direction helps to reduce momentum in lateral direction to help improve flame interaction between stages in lateral direction and achieve better flame propagation between consecutive stages of the set of fuel supply assemblies. Bigger holes in the vertical direction help to control a flame shape toward the centerline axis 957. The outer set of flame shaping passages 978*b* do not include a middle set of flame shaping passages. For the outer set of flame shaping passages 978*b*, holes are removed to ensure a good flame interaction between consecutive stages of the set of fuel supply assemblies and hence better flame propagation and operability for the combustor.

Figure 18:
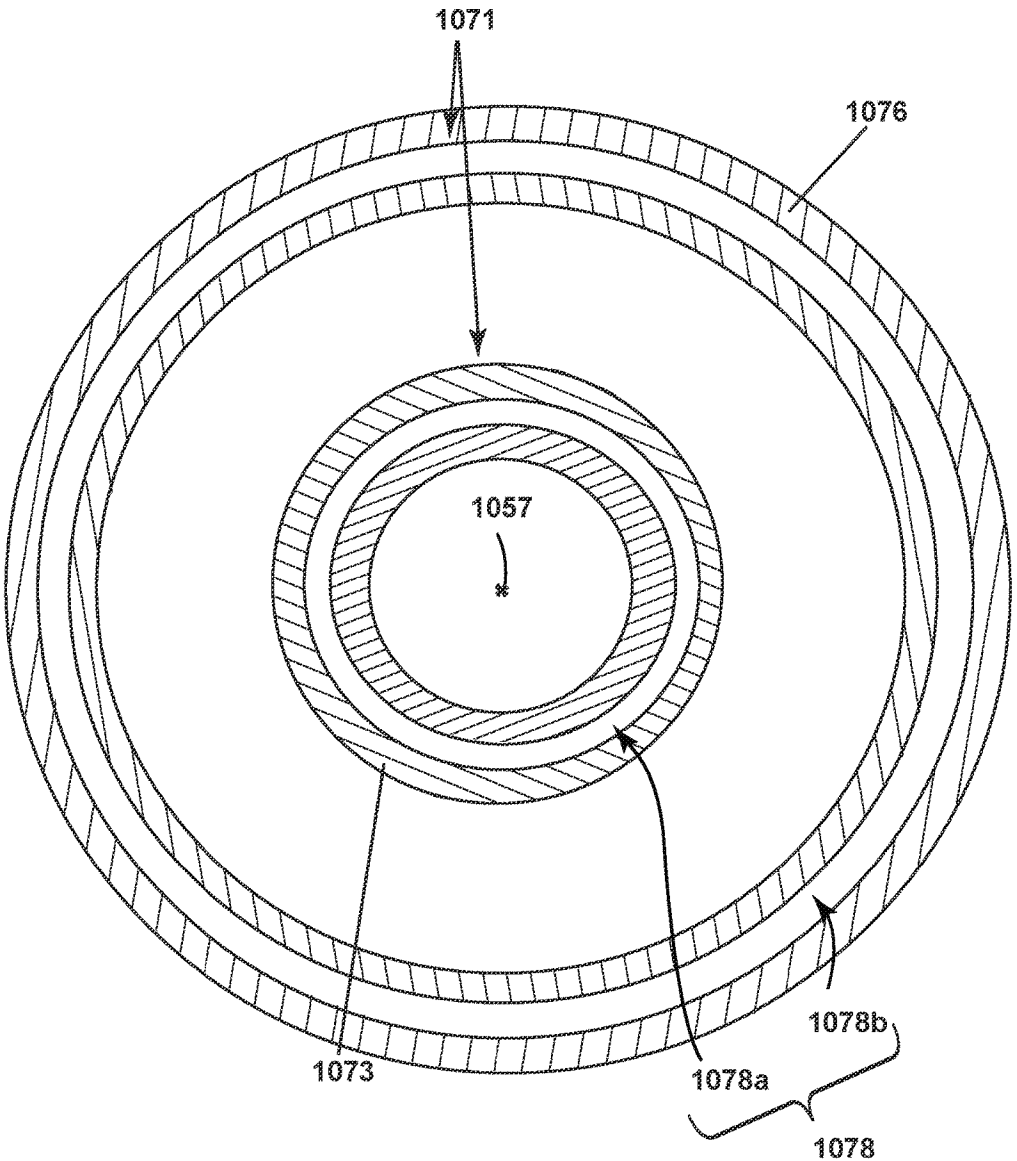
FIG. 18 is an enlarged schematic front cross-sectional view of a portion of a fuel supply assembly suitable for use in the combustion section of FIG. 1 according to another aspect of the disclosure herein.

FIG. 18 is another embodiment of the cross section of FIG. 13 with a set of concentric walls 1071 including a series of flame shaping passages 1078. An inner wall 1073 in the set of concentric walls 1071 includes an inner set of flame shaping passages 1078*a* annular about a centerline axis 1057. An outer wall 1076 in the set of concentric walls 1071 includes an outer set of flame shaping passages 1078*b* annular about the centerline axis 1057.

Figure 19:
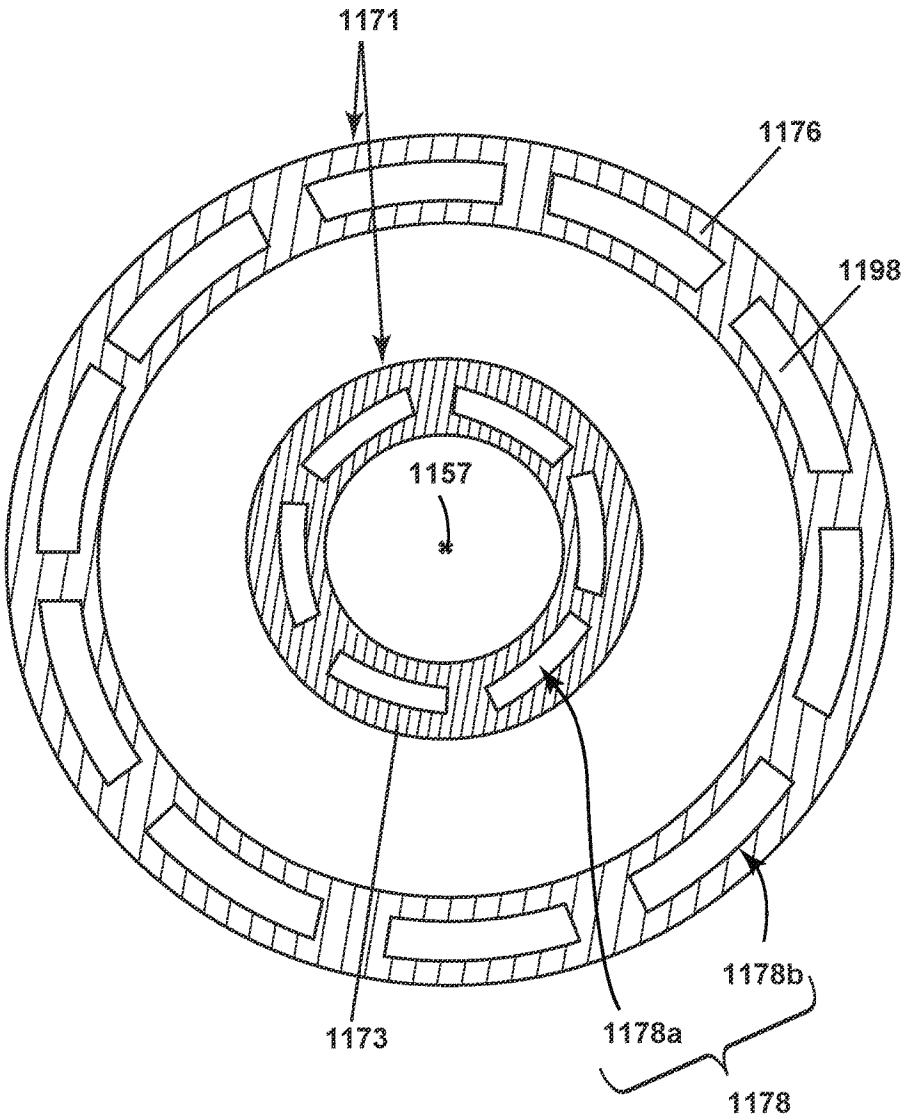
FIG. 19 is an enlarged schematic front cross-sectional view of a portion of a fuel supply assembly suitable for use in the combustion section of FIG. 1 according to another aspect of the disclosure herein.

FIG. 19 is another embodiment of the cross section of FIG. 13 with a set of concentric walls 1171 including a series of flame shaping passages 1178. An inner wall 1173 in the set of concentric walls 1171 includes an inner set of flame shaping passages 1178*a* evenly arranged circumferentially about a centerline axis 1157. An outer wall 1176 in the set of concentric walls 1171 includes an outer set of flame shaping passages 1178*b* evenly arranged circumferentially about the centerline axis 1157. The inner set of flame shaping passages 1178*a* and the outer set of flame shaping passages 1178*b* can have various shapes and sizes, including slots 1198 as illustrated.

Figure 20:
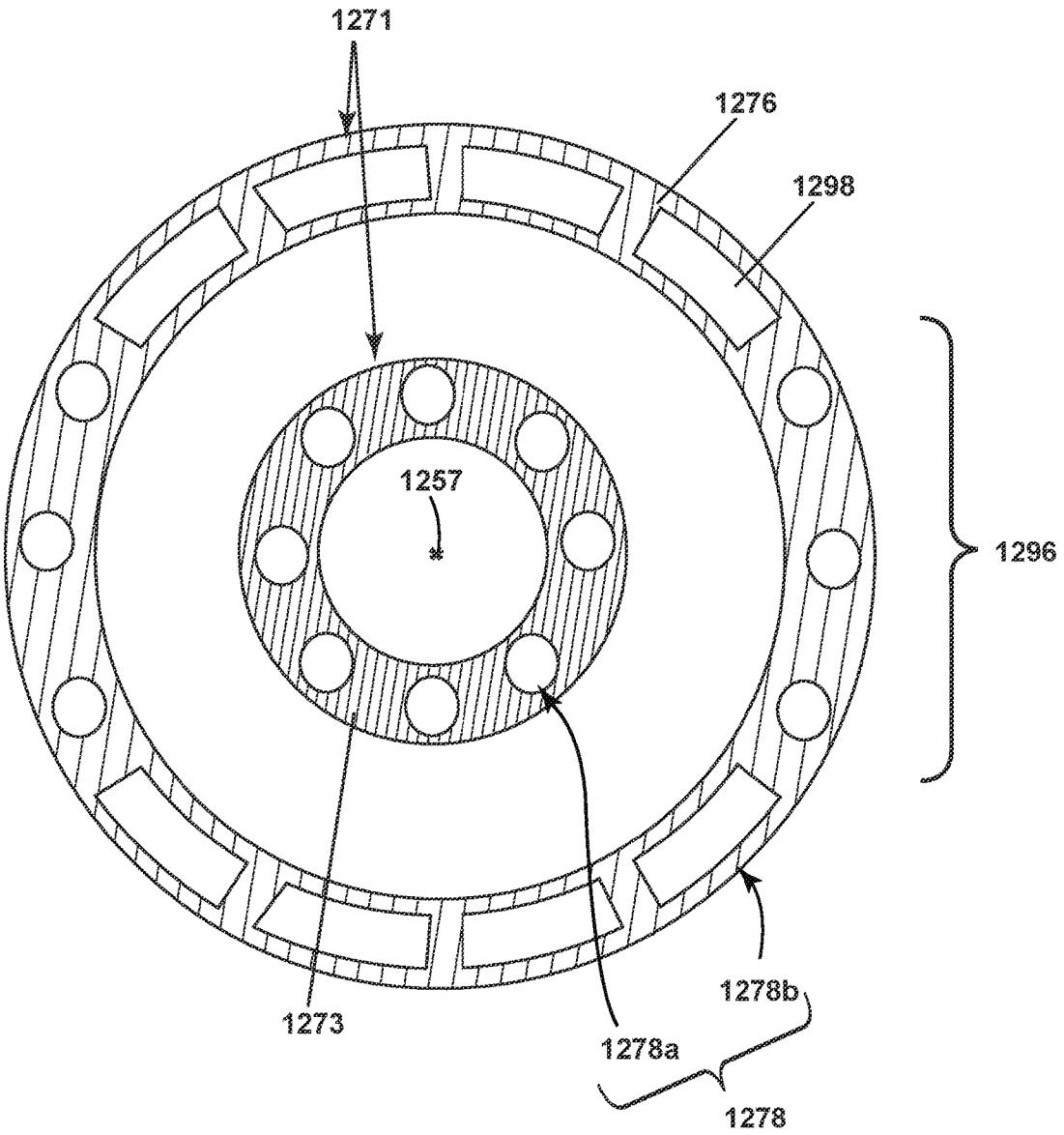
FIG. 20 is an enlarged schematic front cross-sectional view of a portion of a fuel supply assembly suitable for use in the combustion section of FIG. 1 according to another aspect of the disclosure herein.

FIG. 20 is another embodiment of the cross section of FIG. 13 with a set of concentric walls 1271 including a series of flame shaping passages 1278. An inner wall 1273 in the set of concentric walls 1271 includes an inner set of flame shaping passages 1278*a* evenly arranged circumferentially about a centerline axis 1257. An outer wall 1276 in the set of concentric walls 1271 includes an outer set of flame shaping passages 1278*b* evenly arranged circumferentially about the centerline axis 1257. The inner set of flame shaping passages 1278*a* are circular or oval in shape as illustrated. The outer set of flame shaping passages 1278*b* includes a middle set of flame shaping passages 1296 that are circular or oval in shape as illustrated while the remaining flame shaping passages are slots 1298 as illustrated.

Figure 21:
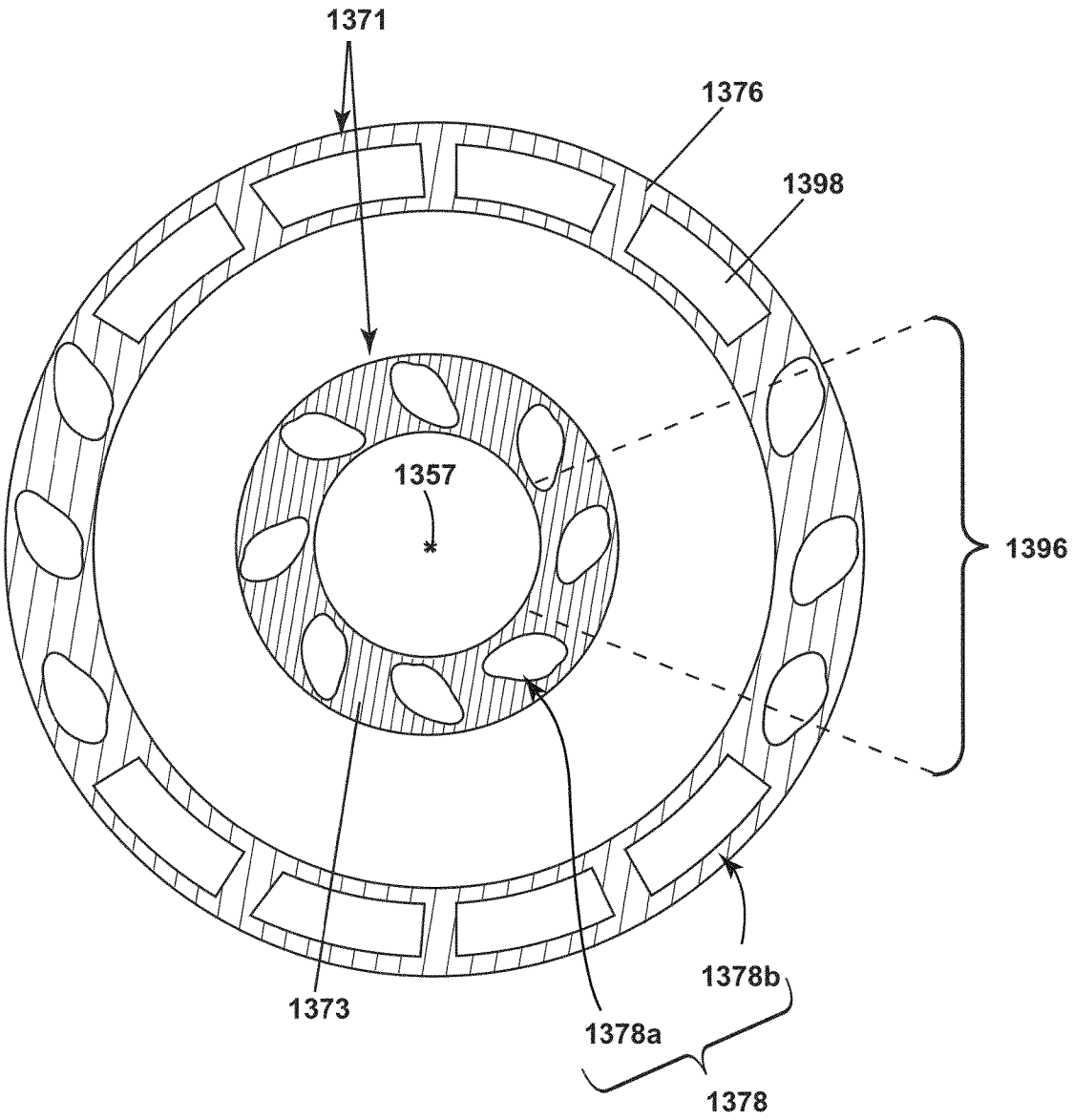
FIG. 21 is an enlarged schematic front cross-sectional view of a portion of a fuel supply assembly suitable for use in the combustion section of FIG. 1 according to another aspect of the disclosure herein.

FIG. 21 is another embodiment of the cross section of FIG. 13 with a set of concentric walls 1371 including a series of flame shaping passages 1378. An inner wall 1373 in the set of concentric walls 1371 includes an inner set of flame shaping passages 1378*a* evenly arranged circumferentially about a centerline axis 1357, all of which have an oblong shape. An outer wall 1376 in the set of concentric walls 1371 includes an outer set of flame shaping passages 1378*b* evenly arranged circumferentially about the centerline axis 1357. The outer set of flame shaping passages 1378*b* includes a middle set of flame shaping passages 1396 that have the oblong in shape as illustrated. The remaining flame shaping passages are slots 1398 as illustrated. The oblong shape can have a tangential orientation to improve mixing between cups and between the inner and outer flame shaping passages 1378*a*, 1378*b*.

Figure 22:
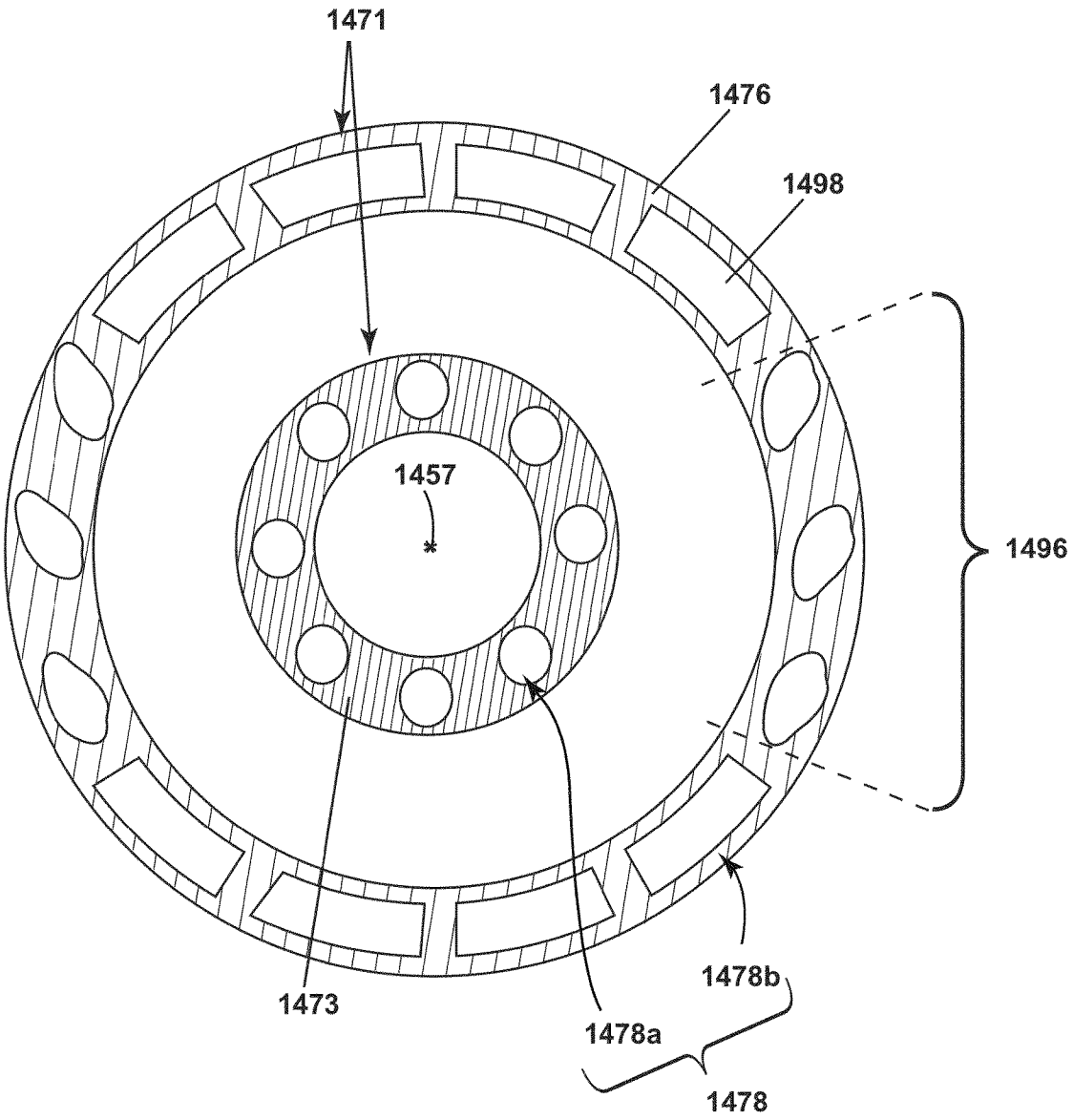
FIG. 22 is an enlarged schematic front cross-sectional view of a portion of a fuel supply assembly suitable for use in the combustion section of FIG. 1 according to yet another aspect of the disclosure herein.

FIG. 22 further illustrates another embodiment of the cross-section of FIG. 13 with a set of concentric walls 1471 including a series of flame shaping passages 1478. An inner wall 1473 in the set of concentric walls 1471 includes an inner set of flame shaping passages 1478*a* evenly arranged circumferentially about a centerline axis 1457, all of which have a circular or oval shape as illustrated. An outer wall 1476 in the set of concentric walls 1471 includes an outer set of flame shaping passages 1478*b* evenly arranged circumferentially about the centerline axis 1457. The outer set of flame shaping passages 1478*b* includes a middle set of flame shaping passages 1496 that have the oblong in shape as illustrated. The remaining flame shaping passages are slots 1498 as illustrated. Holes with an oblong shape are provided on either side laterally as shown to allow for better flow and flame interaction between consecutive fuel supply assemblies. This will also allow for better flame propagation between fuel supply assemblies. This will also achieve a uniform temperature in the combustor thereby reducing NOx emission. Axial or radial slot flow will shape the flame and control the flame structure in the central region of the combustor i.e. away from dome and liner wall thereby protecting these walls from high flame temperature and hence will have better life for dome and liner.

The flame shaping passages as described herein can be any combination of the embodiments illustrated. The passages can include annular passages, discrete passages, slot passages, or any shapes or combination of these shapes. Sizes of the passages can be varied to control the spread of hot gases between the inner and outer fuel/air circuits $F/A_i$, $F/A_o$ as well as between sequential fuel supply assemblies. The series of flame shaping passages described herein can be directed in different directions, including axially, radially inward, radially outward, and the circumferential direction, in order to achieve a desired flame shape and achieve uniform temperature in the combustor thereby reducing NOx emission and better flame propagation for improved combustor operability.

To the extent not already described, the different features and structures of the various embodiments can be used in combination, or in substitution with each other as desired. That is, any dilution hole coupling compressed air to the combustion chamber can include one or more of the aspects described herein. By way of non-limiting example, one or more dilution holes can include a channel or single radiused inlet fluidly coupled to one or more passages. By way of further non-limiting example, one or more dilution holes can include a chamber portion upstream of the outlet or at least one aperture. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. Further, the radiused inlet coupled to the passageway can be applied to any flow path providing flow through one or more portions or components of a turbine engine. That is, aspects of the disclosure are illustrated in the context of the dilution holes of a combustor, however, other passages within the turbine engine are contemplated. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A turbine engine comprising a compressor section, a combustion section, and a turbine section in serial fluid arrangement, the combustion section comprising a combustor liner and a dome wall collectively forming at least a portion of a combustion chamber, with the dome wall having an opening; and a fuel supply assembly coupled to and extending through the opening, the fuel supply assembly comprising a fuel nozzle extending along a centerline axis; a series of air injectors surrounding the fuel nozzle and comprising an outermost air injector; a set of fuel injectors interspersed within the series of air injectors; an inner set of flame shaping passages located between the set of fuel injectors and the primary fuel nozzle; and an outer set of flame shaping passages surrounding the outermost air injector of the series of air injectors.

The turbine engine of any preceding clause, wherein the fuel nozzle comprises a first air supply conduit terminating in a first air outlet, and extending along a centerline axis and a first fuel supply conduit surrounding the first air supply conduit and terminating in a first fuel outlet surrounding the first air outlet to define at least a portion of an inner fuel/air circuit.

The turbine engine of any preceding clause, wherein the inner set of flame shaping passages are formed to control a flame shape produced in a central region of the combustion chamber.

The turbine engine of any preceding clause, wherein the set of fuel injectors comprises a second fuel supply conduit terminating in a second fuel outlet.

The turbine engine of any preceding clause, wherein the outer set of flame shaping passages are for controlling an overall flame structure within the combustion chamber.

The turbine engine of any preceding clause, wherein the inner set of flame shaping passages are circumferentially arranged about the centerline axis.

The turbine engine of any preceding clause, wherein the outer set of flame shaping passages are circumferentially arranged about the centerline axis.

The turbine engine of any preceding clause, wherein the inner and outer sets of flame shaping passages are discrete flame shaping passages.

The turbine engine of any preceding clause, wherein the inner and outer sets of flame shaping passages terminate in an outlet that varies in shape.

The turbine engine of any preceding clause, wherein the shape is any combination of an ellipse, slot, circle or annular passage.

The turbine engine of any preceding clause, wherein the inner and outer sets of flame shaping passages terminate in an outlet that varies in size.

The turbine engine of any preceding clause, wherein the inner and outer sets of flame shaping passages are annular about the centerline axis.

The turbine engine of any preceding clause, wherein the outer set of flame shaping passages comprise a first upper set of flame shaping passages and a first lower set of flame shaping passages separated by a mid-line axis intersecting the centerline axis.

The turbine engine of any preceding clause, wherein the first upper set of flame shaping passages and the first lower set of flame shaping passages include at least one closest discrete flame shaping passage spaced from the mid-line axis a spacing angle.

The turbine engine of any preceding clause, wherein the inner set of flame shaping passages comprise a second upper set of flame shaping passages and a second lower set of flame shaping passages separated by the mid-line axis.

The turbine engine of any preceding clause, wherein the second upper set of flame shaping passages and the second lower set of flame shaping passages include at least one closest discrete flame shaping passage spaced from the mid-line axis by the spacing angle.

The turbine engine of any preceding clause, wherein the spacing angle ranges from 0 to 70 degrees.

The turbine engine of any preceding clause, wherein the inner set of flame shaping passages define an inner passage centerline that forms an inner angle with the centerline axis.

The turbine engine of any preceding clause, wherein the outer set of flame shaping passages define an outer passage centerline that forms an outer angle with the centerline axis.

The turbine engine of any preceding clause, wherein the inner angle and the outer angle range from −70 degrees to +70 degrees.

The turbine engine of any preceding clause, wherein the fuel supply assembly comprises a monolithic body.

The turbine engine of any preceding clause, wherein the set of fuel injectors is multiple fuel injectors.

The turbine engine of any preceding clause, wherein the series of concentrically-arranged air injectors include at least one swirler.

The turbine engine of any preceding clause, wherein a fuel swirler is provided within the first fuel conduit.

The turbine engine of any preceding clause, wherein the first fuel outlet defines a first axial location.

The turbine engine of any preceding clause, wherein the second fuel outlet is located at a second axial location axially downstream of the first axial location.

The turbine engine of any preceding clause, wherein the first fuel outlet defines an outer diameter (D).

The turbine engine of any preceding clause, wherein a first diameter is the diameter associated with the inner set of flame shaping passages and ranges from 1.2D to 30D.

The turbine engine of any preceding clause, wherein a second diameter is the diameter associated with the outer set of flame shaping passages and ranges from ranges from 2D to 40D.

The turbine engine of any preceding clause, further comprising a set of concentric walls including an inner wall terminating in an inner face, wherein the inner wall is located between the set of fuel injectors and the fuel nozzle.

The turbine engine of any preceding clause, wherein the set of concentric walls further comprises an outer wall terminating in an outer face surrounding an outermost air injector of the series of air injectors.

The turbine engine of any preceding clause, wherein a first length is measured along the centerline axis from the inner face to the outer face and ranges from 0 to 20D.

The turbine engine of any preceding clause, wherein a second length is measured along the centerline axis from the inner face to the first fuel outlet and ranges from 0 to 20D.

The turbine engine of any preceding clause, wherein a third length is measured along the centerline axis from the inner face to the second fuel outlet and ranges from −20D to 20D.

The turbine engine of any preceding clause, wherein a fourth length is measured along the centerline axis from the outer face to the second fuel outlet 183*b* and ranges from −20D to 20D.

The turbine engine of any preceding clause, wherein the series of air injectors include an innermost air injector, an intermediate air injector, and an outermost air injector.

The turbine engine of any preceding clause, wherein the fuel nozzle, the inner set of flame shaping passages, and the innermost air injector define an inner fuel/air circuit $F/A_i$.

The turbine engine of any preceding clause, wherein a second fuel supply conduit, the outer set of flame shaping passages, the intermediate air injector, and the outermost air injector define an outer fuel/air circuit $F/A_o$.

The turbine engine of any preceding clause, wherein the inner set of flame shaping passages are formed to provide a first flow of air with a first momentum and the fuel nozzle and a second air outlet are formed to provide a first total swirled airflow with a second momentum, wherein a ratio between the first momentum and the second momentum ranges from 0.2 to 3.0.

The turbine engine of any preceding clause, wherein the first flow of air is 0.1 to 1.5 times the first total swirled airflow.

The turbine engine of any preceding clause, wherein the outer set of flame shaping passages are formed to provide a second flow of air with a third momentum and a third air outlet and a fourth air outlet are formed to provide a second total swirled airflow with a fourth momentum, wherein a ratio between the third momentum and the fourth momentum ranges from 0.4 to 4.0.

The turbine engine of any preceding clause, wherein the second flow of air is 0.1 to 2.0 times the second total swirled airflow.

The turbine engine of any preceding clause, wherein an amount of air and fuel in the inner fuel/air circuit $F/A_i$ is smaller than an amount of air and fuel in the outer fuel/air circuit $F/A_o$.

The turbine engine of any preceding clause, wherein a total swirled airflow is equal to the sum of the first total of swirled airflow and the second total of swirled airflow, and wherein the inner set of flame shaping passages allow 5% to 45% of the total swirled airflow therethrough.

The turbine engine of any preceding clause, wherein the outer set of flame shaping passages allow 10% to 55% of the total swirled airflow therethrough.

The turbine engine of any preceding clause, wherein the inner and outer sets of flame shaping passages are directed in different directions, including axially, radially inward, radially outward, or the circumferential direction.

The turbine engine of any preceding clause, wherein the inner and outer sets of flame shaping passages are directed in any combination of the different directions.

A fuel supply assembly for the turbine engine of any preceding clause.

The invention claimed is:

1. A turbine engine comprising:

a compressor section, a combustion section, and a turbine section in serial fluid arrangement, the combustion section comprising:

a combustor liner and a dome wall collectively forming at least a portion of a combustion chamber, with the dome wall having an opening; and a fuel supply assembly coupled to and extending through the opening, the fuel supply assembly comprising:

a fuel nozzle extending along a centerline axis;

a set of concentric walls arranged about the centerline axis and spaced from each other to define a series of air injectors and a set of fuel injectors, the series of air injectors surrounding the fuel nozzle and comprising an innermost air injector, an intermediate air injector, and an outermost air injector, each of the air injectors defining a respective air injector outlet plane, the set of fuel injectors interspersed within the series of air injectors, the set of concentric walls comprising an inner wall located radially between the set of fuel injectors and the fuel nozzle, and an outer wall located radially between the outermost air injector and the dome wall;

an inner set of flame shaping passages located between the set of fuel injectors and the fuel nozzle and extending through the inner wall, the inner set of flame shaping passages having inner outlets at an axial position upstream from the respective air injector outlet plane of the intermediate air injector, the inner outlets having a first shape; and an outer set of flame shaping passages surrounding the outermost air injector of the series of air injectors and extending through the outer wall, the outer set of flame shaping passages having outer outlets at an axial position downstream from the respective air injector outlet plane of the outermost air injector, the outer outlets comprising a middle set of outer outlets having the first shape and the remaining outer outlets having a second shape different from the first shape;

wherein at least one of the inner set of flame shaping passages or the outer set of flame shaping passages comprises a continuous conduit having a first portion extending axially along the centerline axis and a second portion, downstream of the first portion, that changes direction to extend inward toward the centerline axis, the first and second portions being segments of the same conduit;

wherein the inner set of flame shaping passages are located radially between the fuel nozzle and the intermediate air injector, and the outer set of flame shaping passages are located radially between the outermost air injector and the dome wall.

2. The turbine engine of claim 1, wherein the fuel nozzle comprises a first air supply conduit terminating in a first air outlet, and extending along a centerline axis and a first fuel supply conduit surrounding the first air supply conduit and terminating in a first fuel outlet surrounding the first air outlet to define at least a portion of an inner fuel/air circuit.

3. The turbine engine of claim 2, wherein the inner set of flame shaping passages control spread of an inner flame produced in a central region of the combustion chamber.

4. The turbine engine of claim 3, wherein the set of fuel injectors comprises a second fuel supply conduit terminating in a second fuel outlet.

5. The turbine engine of claim 4, wherein the outer set of flame shaping passages control an overall flame structure within the combustion chamber.

6. The turbine engine of claim 1, wherein the inner set of flame shaping passages are circumferentially arranged about the centerline axis.

7. The turbine engine of claim 6, wherein the outer set of flame shaping passages are circumferentially arranged about the centerline axis.

8. The turbine engine of claim 7, wherein the inner set of flame shaping passages and the outer set of flame shaping passages are discrete flame shaping passages.

9. The turbine engine of claim 8, wherein the inner set of flame shaping passages and the outer set of flame shaping passages terminate in an outlet that varies in shape.

10. The turbine engine of claim 9, wherein the shape is any combination of an ellipse, or a slot, a circle or an annular passage.

11. The turbine engine of claim 7, wherein the inner set of flame shaping passages and the outer set of flame shaping passages terminate in an outlet that varies in size.

12. The turbine engine of claim 7, wherein the outer set of flame shaping passages comprise a first upper set of flame shaping passages and a first lower set of flame shaping passages separated by a mid-line axis intersecting the centerline axis and wherein the first upper set of flame shaping passages and the first lower set of flame shaping passages include at least one closest discrete flame shaping passage spaced from the mid-line axis a spacing angle.

13. The turbine engine of claim 12, wherein the inner set of flame shaping passages comprise a second upper set of flame shaping passages and a second lower set of flame shaping passages separated by the mid-line axis and wherein the second upper set of flame shaping passages and the second lower set of flame shaping passages include at least one closest discrete flame shaping passage spaced from the mid-line axis by the spacing angle.

14. The turbine engine of claim 13, wherein the spacing angle ranges from 0 to 70 degrees.

15. The turbine engine of claim 1, wherein the inner set of flame shaping passages define an inner passage centerline that forms an inner angle with the centerline axis.

16. The turbine engine of claim 15, wherein the outer set of flame shaping passages define an outer passage centerline that forms an outer angle with the centerline axis.

17. The turbine engine of claim 16, wherein the inner angle and the outer angle range from −70 degrees to +70 degrees.

18. The turbine engine of claim 1, wherein the fuel supply assembly comprises a monolithic body.

19. The turbine engine of claim 1, wherein the set of fuel injectors is multiple fuel injectors.

* * * * *